US012760736B1

(12) United States Patent
Poeppelman

(10) Patent No.: US 12,760,736 B1
(45) Date of Patent: Oct. 13, 2026

(54) SCROLL COMPRESSOR WITH VAPOR INJECTION

(71) Applicant: Copeland LP, Sidney, OH (US)

(72) Inventor: Chad M. Poeppelman, Fort Loramie, OH (US)

(73) Assignee: Copeland LP, Sidney, OH (US)

( * ) Notice: Subject to any disclaimer, the term of this patent is extended or adjusted under 35 U.S.C. 154(b) by 0 days.

(21) Appl. No.: 19/259,468

(22) Filed: Jul. 3, 2025

(51) Int. Cl.
*F04C 29/12* (2006.01)
*F04C 18/02* (2006.01)

(52) U.S. Cl.
CPC ..... *F04C 29/12* (2013.01); *F04C 18/0215* (2013.01)

(58) Field of Classification Search
CPC ..... F04C 29/12; F04C 18/0215
See application file for complete search history.

(56) References Cited

U.S. PATENT DOCUMENTS

| | | | |
|---|---|---|---|
| 3,303,988 | A | 2/1967 | Weatherhead |
| 3,777,508 | A | 12/1973 | Imabayashi et al. |
| 4,058,988 | A | 11/1977 | Shaw |
| 4,197,719 | A | 4/1980 | Shaw |
| 4,216,661 | A | 8/1980 | Tojo et al. |
| 4,313,314 | A | 2/1982 | Boyanich |
| 4,382,370 | A | 5/1983 | Suefuji et al. |
| 4,383,805 | A | 5/1983 | Teegarden et al. |

(Continued)

FOREIGN PATENT DOCUMENTS

| | | | |
|---|---|---|---|
| AU | 2002301023 | B2 | 6/2005 |
| CN | 1137614 | A | 12/1996 |

(Continued)

OTHER PUBLICATIONS

Toyama, T.; Nishikawa, Y.; Yoshida, Y.; Hiodoshi, S.; and Shibamoto, Y., "Reduction Of Noise And Over-Compression Loss By Scroll Compressor With Modified Discharge Check Valve" (2002). International Compressor Engineering Conference. Paper 1587.

(Continued)

*Primary Examiner* — Jesse S Bogue
(74) *Attorney, Agent, or Firm* — Harness, Dickey & Pierce, P.L.C.

(57) ABSTRACT

A compressor may include a shell, an end cap, first and second scrolls, and a first fitting member. The end cap extends from an end of the shell. The first scroll is disposed within the shell and includes a first end plate and a first spiral wrap extending from the first end plate. The second scroll is disposed at least partially within the shell and includes a second end plate and a second spiral wrap extending from the second end plate. The first and second spiral wraps cooperate to define fluid pockets therebetween. The fluid pockets are movable from a radially outer position, a radially intermediate position, and a radially inner position. The second end plate includes a capacity-modulation passage in fluid communication with one of the fluid pockets at the radially intermediate position. The first fitting member includes a first mounting surface mounted to a second mounting surface of the second scroll. The first and second mounting surfaces are disposed at a non-perpendicular angle relative to a longitudinal axis of the shell. The first fitting member includes a passage in fluid communication with the capacity-modulation passage.

19 Claims, 6 Drawing Sheets

(56) References Cited

U.S. PATENT DOCUMENTS 4,389,171 A 6/1983 Eber et al.
4,466,784 A 8/1984 Hiraga
4,469,126 A 9/1984 Simpson
4,475,360 A 10/1984 Suefuji et al.
4,475,875 A 10/1984 Sugimoto et al.
4,480,965 A 11/1984 Ishizuka
4,496,296 A 1/1985 Arai et al.
4,497,615 A 2/1985 Griffith
4,508,491 A 4/1985 Schaefer
4,545,742 A 10/1985 Schaefer
4,547,138 A 10/1985 Mabe et al.
4,552,518 A 11/1985 Utter
4,564,339 A 1/1986 Nakamura et al.
4,580,949 A 4/1986 Maruyama et al.
4,609,329 A 9/1986 Pillis et al.
4,650,405 A 3/1987 Iwanami et al.
4,696,630 A 9/1987 Sakata et al.
4,727,725 A 3/1988 Nagata et al.
4,772,188 A 9/1988 Kimura et al.
4,774,816 A 10/1988 Uchikawa et al.
4,818,195 A 4/1989 Murayama et al.
4,824,344 A 4/1989 Kimura et al.
4,838,773 A 6/1989 Noboru
4,842,499 A 6/1989 Nishida et al.
4,846,633 A 7/1989 Suzuki et al.
4,877,382 A 10/1989 Caillat et al.
4,886,425 A 12/1989 Itahana et al.
4,886,433 A 12/1989 Maier
4,893,476 A 1/1990 Bos et al.
4,898,520 A 2/1990 Nieter et al.
4,927,339 A 5/1990 Riffe et al.
4,936,543 A 6/1990 Kamibayasi
4,940,395 A 7/1990 Yamamoto et al.
4,954,057 A 9/1990 Caillat et al.
4,990,071 A 2/1991 Sugimoto
4,997,349 A 3/1991 Richardson, Jr.
5,024,589 A 6/1991 Jetzer et al.
5,040,952 A 8/1991 Inoue et al.
5,040,958 A 8/1991 Arata et al.
5,055,010 A 10/1991 Logan
5,059,098 A 10/1991 Suzuki et al.
5,071,323 A 12/1991 Sakashita et al.
5,074,760 A 12/1991 Hirooka et al.
5,080,056 A 1/1992 Kramer et al.
5,085,565 A 2/1992 Barito
5,098,265 A 3/1992 Machida et al.
5,145,346 A 9/1992 Iio et al.
5,152,682 A 10/1992 Morozumi et al.
RE34,148 E 12/1992 Terauchi et al.
5,169,294 A 12/1992 Barito
5,171,141 A 12/1992 Morozumi et al.
5,192,195 A 3/1993 Iio et al.
5,193,987 A 3/1993 Iio et al.
5,199,862 A 4/1993 Kondo et al.
5,213,489 A 5/1993 Kawahara et al.
5,240,389 A 8/1993 Oikawa et al.
5,253,489 A 10/1993 Yoshii
5,304,047 A 4/1994 Shibamoto
5,318,424 A 6/1994 Bush et al.
5,330,463 A 7/1994 Hirano
5,336,068 A 8/1994 Sekiya et al.
5,340,287 A 8/1994 Kawahara et al.
5,355,688 A 10/1994 Rafalovich et al.
5,356,271 A 10/1994 Miura et al.
5,385,034 A 1/1995 Haselden
5,395,224 A 3/1995 Caillat et al.
5,411,384 A 5/1995 Bass et al.
5,425,626 A 6/1995 Tojo et al.
5,427,512 A 6/1995 Kohsokabe et al.
5,451,146 A 9/1995 Inagaki et al.
5,458,471 A 10/1995 Ni
5,458,472 A 10/1995 Kobayashi et al.
5,482,637 A 1/1996 Rao et al.
5,497,629 A 3/1996 Rafalovich et al.
5,511,959 A 4/1996 Tojo et al.
5,547,354 A 8/1996 Shimizu et al.
5,551,846 A 9/1996 Taylor et al.
5,557,897 A 9/1996 Kranz et al.
5,562,426 A 10/1996 Watanabe et al.
5,577,897 A 11/1996 Inagaki et al.
5,591,014 A 1/1997 Wallis et al.
5,607,288 A 3/1997 Wallis et al.
5,611,674 A 3/1997 Bass et al.
5,613,841 A 3/1997 Bass et al.
5,622,487 A 4/1997 Fukuhara et al.
5,624,247 A 4/1997 Nakamura
5,639,225 A 6/1997 Matsuda et al.
5,640,854 A 6/1997 Fogt et al.
5,649,817 A 7/1997 Yamazaki
5,660,539 A 8/1997 Matsunaga et al.
5,667,371 A 9/1997 Prenger et al.
5,674,058 A 10/1997 Matsuda et al.
5,678,626 A 10/1997 Gilles
5,678,985 A * 10/1997 Brooke ..... F04C 28/14 417/310
5,680,898 A 10/1997 Rafalovich et al.
5,707,210 A 1/1998 Ramsey et al.
5,722,257 A 3/1998 Ishii et al.
5,741,120 A 4/1998 Bass et al.
5,755,104 A 5/1998 Rafalovich et al.
5,775,893 A 7/1998 Takao et al.
5,791,328 A 8/1998 Alexander
5,842,843 A 12/1998 Haga
5,855,475 A 1/1999 Fujio et al.
5,885,063 A 3/1999 Makino et al.
5,888,057 A 3/1999 Kitano et al.
5,938,417 A 8/1999 Takao et al.
5,993,171 A 11/1999 Higashiyama
5,993,177 A 11/1999 Terauchi et al.
6,010,312 A 1/2000 Suitou et al.
6,015,277 A 1/2000 Richardson, Jr.
6,030,192 A 2/2000 Hill et al.
6,047,557 A 4/2000 Pham et al.
6,056,523 A 5/2000 Won et al.
6,065,948 A 5/2000 Brown
6,068,459 A 5/2000 Clarke et al.
6,086,335 A 7/2000 Bass et al.
6,093,005 A 7/2000 Nakamura
6,095,764 A 8/2000 Shibamoto et al.
6,095,765 A 8/2000 Khalifa
6,102,671 A 8/2000 Yamamoto et al.
6,120,255 A 9/2000 Schumann et al.
6,123,517 A 9/2000 Brooke et al.
6,123,528 A 9/2000 Sun et al.
6,132,179 A 10/2000 Higashiyama
6,132,191 A 10/2000 Hugenroth et al.
6,139,287 A 10/2000 Kuroiwa et al.
6,139,291 A 10/2000 Perevozchikov
6,149,401 A 11/2000 Iwanami et al.
6,152,714 A 11/2000 Mitsuya et al.
6,164,940 A 12/2000 Terauchi et al.
6,174,149 B1 1/2001 Bush
6,176,686 B1 1/2001 Wallis et al.
6,179,589 B1 1/2001 Bass et al.
6,182,646 B1 2/2001 Silberstein et al.
6,202,438 B1 3/2001 Barito
6,210,120 B1 4/2001 Hugenroth et al.
6,213,731 B1 4/2001 Doepker et al.
6,217,302 B1 4/2001 Sun et al.
6,224,356 B1 5/2001 Dewar et al.
6,227,830 B1 5/2001 Fields et al.
6,231,316 B1 5/2001 Wakisaka et al.
6,257,840 B1 7/2001 Ignatiev et al.
6,264,444 B1 7/2001 Nakane et al.
6,264,452 B1 7/2001 Sun et al.
6,267,565 B1 7/2001 Seibel et al.
6,273,691 B1 8/2001 Morimoto et al.
6,280,154 B1 8/2001 Clendenin et al.
6,290,477 B1 9/2001 Gigon
6,293,767 B1 * 9/2001 Bass ..... F04C 27/005 417/310
6,293,776 B1 9/2001 Hahn et al.
6,309,194 B1 10/2001 Fraser et al.
6,322,340 B1 11/2001 Itoh et al.

(56) References Cited

U.S. PATENT DOCUMENTS 6,327,871 B1 12/2001 Rafalovich
6,338,912 B1 1/2002 Ban et al.
6,350,111 B1 2/2002 Perevozchikov et al.
6,361,890 B1 3/2002 Ban et al.
6,379,123 B1 4/2002 Makino et al.
6,379,133 B1 4/2002 Hahn et al.
6,389,837 B1 5/2002 Morozumi
6,412,293 B1 7/2002 Pham et al.
6,413,058 B1 7/2002 Williams et al.
6,419,457 B1 7/2002 Seibel et al.
6,422,842 B2 7/2002 Sheridan et al.
6,428,286 B1 8/2002 Shimizu et al.
6,454,551 B2 9/2002 Kuroki et al.
6,457,948 B1 10/2002 Pham
6,457,952 B1 10/2002 Haller et al.
6,464,481 B2 10/2002 Tsubai et al.
6,478,550 B2 11/2002 Matsuba et al.
6,506,036 B2 1/2003 Tsubai et al.
6,514,060 B1 2/2003 Ishiguro et al.
6,537,043 B1 3/2003 Chen
6,544,016 B2 4/2003 Gennami et al.
6,558,143 B2 5/2003 Nakajima et al.
6,589,035 B1 7/2003 Tsubono et al.
6,619,062 B1 9/2003 Shibamoto et al.
6,619,936 B2 9/2003 Perevozchikov
6,672,845 B1 1/2004 Kim et al.
6,672,846 B2 * 1/2004 Rajendran ..... F04C 23/001 417/410.5
6,679,683 B2 1/2004 Seibel et al.
6,705,848 B2 3/2004 Scancarello
6,715,999 B2 4/2004 Ancel et al.
6,745,584 B2 6/2004 Pham et al.
6,746,223 B2 6/2004 Manole
6,749,412 B2 6/2004 Narasipura et al.
6,769,881 B2 8/2004 Lee
6,769,888 B2 8/2004 Tsubono et al.
6,773,242 B1 8/2004 Perevozchikov
6,817,847 B2 11/2004 Agner
6,821,092 B1 11/2004 Gehret et al.
6,863,510 B2 3/2005 Cho
6,881,046 B2 4/2005 Shibamoto et al.
6,884,042 B2 4/2005 Zili et al.
6,887,051 B2 5/2005 Sakuda et al.
6,893,229 B2 5/2005 Choi et al.
6,896,493 B2 5/2005 Chang et al.
6,896,498 B1 5/2005 Patel
6,913,448 B2 7/2005 Liang et al.
6,984,114 B2 1/2006 Zili et al.
7,018,180 B2 3/2006 Koo
7,029,251 B2 4/2006 Chang et al.
7,112,046 B2 9/2006 Kammhoff et al.
7,118,358 B2 10/2006 Tsubono et al.
7,137,796 B2 11/2006 Tsubono et al.
7,160,088 B2 1/2007 Peyton
7,172,395 B2 2/2007 Shibamoto et al.
7,197,890 B2 4/2007 Taras et al.
7,207,787 B2 4/2007 Liang et al.
7,228,710 B2 6/2007 Lifson
7,229,261 B2 6/2007 Morimoto et al.
7,255,542 B2 8/2007 Lifson et al.
7,261,527 B2 8/2007 Alexander et al.
7,311,740 B2 12/2007 Williams et al.
7,344,365 B2 3/2008 Takeuchi et al.
RE40,257 E 4/2008 Doepker et al.
7,354,259 B2 4/2008 Tsubono et al.
7,364,416 B2 4/2008 Liang et al.
7,371,057 B2 5/2008 Shin et al.
7,371,059 B2 5/2008 Ignatiev et al.
RE40,399 E 6/2008 Hugenroth et al.
RE40,400 E 6/2008 Bass et al.
7,393,190 B2 7/2008 Lee et al.
7,404,706 B2 7/2008 Ishikawa et al.
7,421,846 B2 9/2008 Narayanamurthy et al.
7,429,167 B2 9/2008 Bonear et al.
RE40,554 E 10/2008 Bass et al.
7,484,374 B2 2/2009 Pham et al.
7,510,382 B2 3/2009 Jeong
7,547,202 B2 6/2009 Knapke
7,641,455 B2 1/2010 Fujiwara et al.
7,674,098 B2 3/2010 Lifson
7,695,257 B2 4/2010 Joo et al.
7,717,687 B2 5/2010 Reinhart
7,771,178 B2 8/2010 Perevozchikov et al.
7,802,972 B2 9/2010 Shimizu et al.
7,815,423 B2 * 10/2010 Guo ..... F04C 29/042 418/55.1
7,827,809 B2 11/2010 Pham et al.
7,891,961 B2 2/2011 Shimizu et al.
7,896,629 B2 3/2011 Ignatiev et al.
RE42,371 E 5/2011 Peyton
7,956,501 B2 6/2011 Jun et al.
7,967,582 B2 6/2011 Akei et al.
7,967,583 B2 6/2011 Stover et al.
7,972,125 B2 7/2011 Stover et al.
7,976,289 B2 7/2011 Masao
7,976,295 B2 7/2011 Stover et al.
7,988,433 B2 * 8/2011 Akei ..... F04C 27/005 417/310
7,988,434 B2 8/2011 Stover et al.
8,020,402 B2 9/2011 Pham et al.
8,025,492 B2 9/2011 Seibel et al.
8,079,229 B2 12/2011 Lifson et al.
8,162,622 B2 4/2012 Shoulders
8,181,470 B2 5/2012 Narayanamurthy et al.
8,303,278 B2 11/2012 Roof et al.
8,303,279 B2 11/2012 Hahn
8,308,448 B2 11/2012 Fields et al.
8,313,318 B2 11/2012 Stover et al.
8,328,531 B2 12/2012 Milliff et al.
8,328,543 B2 12/2012 Wilson
8,393,882 B2 3/2013 Ignatiev et al.
8,424,326 B2 4/2013 Mitra et al.
8,505,331 B2 8/2013 Pham et al.
8,506,271 B2 8/2013 Seibel et al.
8,517,703 B2 8/2013 Doepker
8,585,382 B2 11/2013 Akei et al.
8,616,014 B2 12/2013 Stover et al.
8,672,646 B2 3/2014 Ishizono et al.
8,707,723 B2 4/2014 Narayanamurthy
8,757,988 B2 6/2014 Fukudome et al.
8,790,098 B2 7/2014 Stover et al.
8,840,384 B2 9/2014 Patel et al.
8,857,200 B2 10/2014 Stover et al.
8,932,036 B2 1/2015 Monnier et al.
9,068,765 B2 6/2015 Huff
9,080,446 B2 7/2015 Heusler et al.
9,127,677 B2 9/2015 Doepker
9,145,891 B2 9/2015 Kim et al.
9,169,839 B2 10/2015 Ishizono et al.
9,194,395 B2 11/2015 Ginies et al.
9,217,433 B2 12/2015 Park et al.
9,228,587 B2 1/2016 Lee et al.
9,249,802 B2 2/2016 Doepker et al.
9,297,383 B2 3/2016 Jin et al.
9,303,642 B2 4/2016 Akei et al.
9,360,011 B2 6/2016 Perevozchikov et al.
9,435,340 B2 9/2016 Doepker et al.
9,494,157 B2 11/2016 Doepker
9,541,084 B2 1/2017 Ignatiev et al.
9,556,862 B2 1/2017 Yoshihiro et al.
9,581,265 B2 2/2017 Sherbeck et al.
9,605,677 B2 3/2017 Heidecker et al.
9,612,042 B2 4/2017 Sjoholm et al.
9,624,928 B2 4/2017 Yamazaki et al.
9,638,191 B2 5/2017 Stover
9,651,043 B2 5/2017 Stover et al.
9,777,730 B2 10/2017 Doepker et al.
9,777,863 B2 10/2017 Higashidozono et al.
9,790,940 B2 10/2017 Doepker et al.
9,797,400 B2 10/2017 Yun et al.
9,850,903 B2 * 12/2017 Perevozchikov ..... F04C 15/06
9,869,315 B2 1/2018 Jang et al.
9,879,674 B2 1/2018 Akei et al.
9,885,347 B2 2/2018 Lachey et al.

(56) References Cited

U.S. PATENT DOCUMENTS 9,920,759 B2 3/2018 Sung et al.
9,926,932 B2 3/2018 Perevozchikov et al.
9,989,057 B2 6/2018 Lochner et al.
10,047,985 B2 8/2018 Kopko
10,066,622 B2 9/2018 Pax et al.
10,087,936 B2 10/2018 Pax et al.
10,088,202 B2 10/2018 Huff et al.
10,094,380 B2 10/2018 Doepker et al.
10,180,257 B2 1/2019 Cur et al.
10,197,306 B2 2/2019 Li et al.
10,323,639 B2 6/2019 Doepker et al.
10,428,818 B2 10/2019 Jin et al.
10,535,245 B2 1/2020 Callemo et al.
10,563,891 B2 2/2020 Smerud et al.
10,724,523 B2 7/2020 Wu et al.
10,815,999 B2 10/2020 Jeong
10,830,503 B2 11/2020 Kopko
10,907,633 B2 2/2021 Doepker et al.
10,928,108 B2 * 2/2021 Piscopo ..... F04B 39/06
10,954,940 B2 3/2021 Akei et al.
10,974,317 B2 4/2021 Ruxanda et al.
11,209,000 B2 12/2021 Moore et al.
11,231,034 B2 1/2022 Funakoshi et al.
11,300,329 B2 4/2022 Yan et al.
11,371,504 B2 6/2022 Ma et al.
11,378,290 B2 7/2022 Locke et al.
11,493,040 B2 11/2022 Zou et al.
11,592,215 B2 2/2023 Brown
11,768,018 B2 9/2023 Desmarais
11,846,287 B1 12/2023 Gehret et al.
11,846,454 B2 12/2023 Temple
11,905,953 B2 2/2024 Liang et al.
11,959,690 B2 4/2024 LeRoy
12,031,755 B2 7/2024 Catano-Montoya
12,173,708 B1 12/2024 Butler et al.
2001/0010800 A1 8/2001 Kohsokabe et al.
2002/0039540 A1 4/2002 Kuroki et al.
2002/0057975 A1 5/2002 Nakajima et al.
2002/0114720 A1 8/2002 Itoh et al.
2003/0044296 A1 3/2003 Chen
2003/0044297 A1 3/2003 Gennami et al.
2003/0186060 A1 10/2003 Rao
2003/0228235 A1 12/2003 Sowa et al.
2004/0126259 A1 7/2004 Choi et al.
2004/0136854 A1 7/2004 Kimura et al.
2004/0146419 A1 7/2004 Kawaguchi et al.
2004/0170509 A1 9/2004 Wehrenberg et al.
2004/0184932 A1 9/2004 Lifson
2004/0197204 A1 10/2004 Yamanouchi et al.
2004/0206110 A1 10/2004 Lifson et al.
2005/0019177 A1 1/2005 Shin et al.
2005/0019178 A1 1/2005 Shin et al.
2005/0053507 A1 3/2005 Takeuchi et al.
2005/0069444 A1 3/2005 Peyton
2005/0120733 A1 6/2005 Healy et al.
2005/0140232 A1 6/2005 Lee et al.
2005/0142017 A1 6/2005 Liang et al.
2005/0201883 A1 9/2005 Clendenin et al.
2005/0214148 A1 9/2005 Ogawa et al.
2006/0099098 A1 5/2006 Lee et al.
2006/0138879 A1 6/2006 Kusase et al.
2006/0198748 A1 9/2006 Grassbaugh et al.
2006/0228243 A1 10/2006 Sun et al.
2006/0233657 A1 10/2006 Bonear et al.
2006/0266076 A1 * 11/2006 Lifson ..... F04C 18/0253 62/513
2007/0003666 A1 1/2007 Gutknecht et al.
2007/0036661 A1 2/2007 Stover
2007/0110604 A1 5/2007 Peyton
2007/0130973 A1 6/2007 Lifson et al.
2007/0148026 A1 6/2007 Higashi
2007/0194261 A1 8/2007 Kato et al.
2008/0034772 A1 2/2008 Chumley et al.
2008/0115357 A1 5/2008 Li et al.
2008/0138227 A1 6/2008 Knapke
2008/0159892 A1 7/2008 Huang et al.
2008/0159893 A1 7/2008 Caillat
2008/0184733 A1 8/2008 Skinner
2008/0196445 A1 8/2008 Lifson et al.
2008/0197206 A1 8/2008 Murakami et al.
2008/0223057 A1 9/2008 Lifson et al.
2008/0226483 A1 9/2008 Iwanami et al.
2008/0286118 A1 11/2008 Gu et al.
2008/0305270 A1 12/2008 Uhlianuk et al.
2009/0013701 A1 1/2009 Lifson et al.
2009/0035167 A1 2/2009 Sun
2009/0068048 A1 3/2009 Stover et al.
2009/0071183 A1 * 3/2009 Stover ..... F04C 18/0215 418/55.1
2009/0185935 A1 7/2009 Seibel et al.
2009/0191080 A1 7/2009 Ignatiev et al.
2009/0205345 A1 8/2009 Narayanamurthy et al.
2009/0288430 A1 11/2009 Anderson
2009/0293507 A1 12/2009 Narayanamurthy et al.
2009/0297377 A1 12/2009 Stover et al.
2009/0297378 A1 12/2009 Stover et al.
2009/0297379 A1 12/2009 Stover et al.
2009/0297380 A1 12/2009 Stover et al.
2010/0111741 A1 5/2010 Chikano et al.
2010/0135836 A1 6/2010 Stover et al.
2010/0158731 A1 6/2010 Akei et al.
2010/0209278 A1 8/2010 Tarao et al.
2010/0212311 A1 8/2010 McQuary et al.
2010/0212352 A1 8/2010 Kim et al.
2010/0254841 A1 10/2010 Akei et al.
2010/0300659 A1 12/2010 Stover et al.
2010/0303659 A1 * 12/2010 Stover ..... F04C 29/0007 418/24
2011/0052437 A1 3/2011 Litsuka et al.
2011/0135509 A1 6/2011 Fields et al.
2011/0154848 A1 6/2011 Jin
2011/0174014 A1 7/2011 Scarcella et al.
2011/0206548 A1 8/2011 Doepker
2011/0232320 A1 9/2011 Satou
2011/0243777 A1 10/2011 Ito et al.
2011/0250085 A1 10/2011 Stover et al.
2011/0293456 A1 12/2011 Seibel et al.
2011/0308762 A1 12/2011 Spero et al.
2012/0009076 A1 1/2012 Kim et al.
2012/0067070 A1 3/2012 Albertson
2012/0107163 A1 5/2012 Monnier et al.
2012/0148433 A1 6/2012 Liang et al.
2012/0183422 A1 7/2012 Bahmata
2012/0195781 A1 8/2012 Stover et al.
2013/0061627 A1 3/2013 Neumeister et al.
2013/0078128 A1 3/2013 Akei
2013/0089448 A1 4/2013 Ginies et al.
2013/0094987 A1 4/2013 Yamashita et al.
2013/0098071 A1 4/2013 Means
2013/0121857 A1 5/2013 Liang et al.
2013/0177465 A1 7/2013 Clendenin et al.
2013/0195707 A1 8/2013 Kozuma et al.
2013/0302198 A1 11/2013 Ginies et al.
2013/0309118 A1 11/2013 Ginies et al.
2013/0315768 A1 11/2013 Le Coat et al.
2014/0023540 A1 1/2014 Heidecker et al.
2014/0024563 A1 1/2014 Heidecker et al.
2014/0037486 A1 2/2014 Stover et al.
2014/0134030 A1 5/2014 Stover et al.
2014/0134031 A1 5/2014 Doepker et al.
2014/0147294 A1 5/2014 Fargo et al.
2014/0154121 A1 6/2014 Doepker
2014/0154124 A1 6/2014 Doepker et al.
2014/0219846 A1 8/2014 Ignatiev et al.
2015/0037184 A1 2/2015 Rood et al.
2015/0086404 A1 3/2015 Kiem et al.
2015/0192121 A1 7/2015 Sung et al.
2015/0233375 A1 8/2015 Kim et al.
2015/0275898 A1 10/2015 Ahire et al.
2015/0300353 A1 10/2015 Utpat et al.
2015/0330386 A1 * 11/2015 Doepker ..... F04C 28/26 418/55.2
2015/0345493 A1 12/2015 Lochner et al.
2015/0354719 A1 12/2015 Van Beek et al.

(56) References Cited

U.S. PATENT DOCUMENTS

| | | | |
|---|---|---|---|
| 2016/0025093 | A1 | 1/2016 | Doepker |
| 2016/0025094 | A1 | 1/2016 | Ignatiev et al. |
| 2016/0032924 | A1 | 2/2016 | Stover |
| 2016/0047380 | A1 | 2/2016 | Kim et al. |
| 2016/0053755 | A1 | 2/2016 | Taguchi |
| 2016/0053759 | A1 | 2/2016 | Choi et al. |
| 2016/0076543 | A1 | 3/2016 | Akei et al. |
| 2016/0115954 | A1 | 4/2016 | Doepker et al. |
| 2016/0138732 | A1 | 5/2016 | Lively et al. |
| 2016/0138879 | A1 | 5/2016 | Matsukado et al. |
| 2016/0178253 | A1 | 6/2016 | Katoh et al. |
| 2016/0201673 | A1 | 7/2016 | Perevozchikov et al. |
| 2016/0208803 | A1 | 7/2016 | Uekawa et al. |
| 2016/0238265 | A1 | 8/2016 | Sherbeck et al. |
| 2016/0272047 | A1 | 9/2016 | Gan |
| 2017/0002817 | A1 | 1/2017 | Stover |
| 2017/0002818 | A1 | 1/2017 | Stover |
| 2017/0030354 | A1 | 2/2017 | Stover |
| 2017/0097108 | A1 | 4/2017 | Huff |
| 2017/0152957 | A1 | 6/2017 | Roche et al. |
| 2017/0241417 | A1 | 8/2017 | Jin et al. |
| 2017/0268510 | A1 | 9/2017 | Stover et al. |
| 2017/0306960 | A1 | 10/2017 | Pax et al. |
| 2017/0314558 | A1 | 11/2017 | Pax et al. |
| 2017/0342978 | A1 | 11/2017 | Doepker |
| 2017/0342983 | A1 | 11/2017 | Jin et al. |
| 2017/0342984 | A1 | 11/2017 | Jin et al. |
| 2018/0023570 | A1 | 1/2018 | Huang et al. |
| 2018/0038369 | A1 | 2/2018 | Doepker et al. |
| 2018/0038370 | A1 | 2/2018 | Doepker et al. |
| 2018/0066656 | A1 | 3/2018 | Perevozchikov et al. |
| 2018/0066657 | A1 | 3/2018 | Perevozchikov et al. |
| 2018/0135625 | A1 | 5/2018 | Naganuma et al. |
| 2018/0149155 | A1 | 5/2018 | Akei et al. |
| 2018/0216618 | A1 | 8/2018 | Jeong |
| 2018/0223823 | A1 | 8/2018 | Ignatiev et al. |
| 2018/0363965 | A1 | 12/2018 | Hayamizu et al. |
| 2019/0040861 | A1 | 2/2019 | Doepker et al. |
| 2019/0041107 | A1 | 2/2019 | Piscopo et al. |
| 2019/0101120 | A1 | 4/2019 | Perevozchikov et al. |
| 2019/0107300 | A1 | 4/2019 | Locke et al. |
| 2019/0162185 | A1 | 5/2019 | Mizushima et al. |
| 2019/0186491 | A1 | 6/2019 | Perevozchikov et al. |
| 2019/0203709 | A1 | 7/2019 | Her et al. |
| 2019/0210425 | A1 | 7/2019 | Azzouz et al. |
| 2019/0277288 | A1 | 9/2019 | Flanigan et al. |
| 2019/0285318 | A1 | 9/2019 | Kopko |
| 2019/0309993 | A1 | 10/2019 | Zaynulin et al. |
| 2019/0353164 | A1 | 11/2019 | Berning et al. |
| 2020/0057458 | A1 | 2/2020 | Taguchi |
| 2020/0291943 | A1 | 9/2020 | McBean et al. |
| 2020/0370808 | A1 | 11/2020 | Feng et al. |
| 2021/0018234 | A1 | 1/2021 | Lingrey et al. |
| 2021/0222788 | A1 | 7/2021 | Willers et al. |
| 2021/0262470 | A1 | 8/2021 | Wei et al. |
| 2022/0065504 | A1 | 3/2022 | Zou |
| 2022/0235774 | A1 | 7/2022 | Cui et al. |
| 2023/0030270 | A1 | 2/2023 | Andersson et al. |
| 2023/0296097 | A1* | 9/2023 | Bercot ..... F16K 31/0606 418/55.4 |
| 2023/0366599 | A1 | 11/2023 | Yu |
| 2023/0392835 | A1 | 12/2023 | Butler et al. |
| 2023/0400022 | A1 | 12/2023 | Jo et al. |
| 2024/0035717 | A1 | 2/2024 | Zou et al. |
| 2024/0247819 | A1 | 7/2024 | Pedretti |
| 2025/0172141 | A1* | 5/2025 | Liu ..... F04C 18/0215 |

FOREIGN PATENT DOCUMENTS

| | | | |
|---|---|---|---|
| CN | 1158944 | A | 9/1997 |
| CN | 1158945 | A | 9/1997 |
| CN | 1177681 | A | 4/1998 |
| CN | 1177683 | A | 4/1998 |
| CN | 1259625 | A | 7/2000 |
| CN | 1286358 | A | 3/2001 |
| CN | 1289011 | A | 3/2001 |
| CN | 1339087 | A | 3/2002 |
| CN | 1349053 | A | 5/2002 |
| CN | 1382912 | A | 12/2002 |
| CN | 1407233 | A | 4/2003 |
| CN | 1407234 | A | 4/2003 |
| CN | 1517553 | A | 8/2004 |
| CN | 1601106 | A | 3/2005 |
| CN | 1680720 | A | 10/2005 |
| CN | 1702328 | A | 11/2005 |
| CN | 2747381 | Y | 12/2005 |
| CN | 1757925 | A | 4/2006 |
| CN | 1828022 | A | 9/2006 |
| CN | 1854525 | A | 11/2006 |
| CN | 1963214 | A | 5/2007 |
| CN | 1995756 | A | 7/2007 |
| CN | 101358592 | A | 2/2009 |
| CN | 101684785 | A | 3/2010 |
| CN | 101761479 | A | 6/2010 |
| CN | 101806302 | A | 8/2010 |
| CN | 101910637 | A | 12/2010 |
| CN | 102076963 | A | 5/2011 |
| CN | 102089525 | A | 6/2011 |
| CN | 102272454 | A | 12/2011 |
| CN | 102400915 | A | 4/2012 |
| CN | 102422024 | A | 4/2012 |
| CN | 102449314 | A | 5/2012 |
| CN | 102705234 | A | 10/2012 |
| CN | 102762866 | A | 10/2012 |
| CN | 202926640 | U | 5/2013 |
| CN | 103502644 | A | 1/2014 |
| CN | 103671125 | A | 3/2014 |
| CN | 203962320 | U | 11/2014 |
| CN | 204041454 | U | 12/2014 |
| CN | 104838143 | A | 8/2015 |
| CN | 105317678 | A | 2/2016 |
| CN | 205533207 | U | 8/2016 |
| CN | 205823629 | U | 12/2016 |
| CN | 205876712 | U | 1/2017 |
| CN | 205876713 | U | 1/2017 |
| CN | 205895597 | U | 1/2017 |
| CN | 106662104 | A | 5/2017 |
| CN | 106979153 | A | 7/2017 |
| CN | 207513832 | U | 6/2018 |
| CN | 207795587 | U | 8/2018 |
| CN | 207974880 | U | 10/2018 |
| CN | 209621603 | U | 11/2019 |
| CN | 209654225 | U | 11/2019 |
| CN | 110529628 | A | 12/2019 |
| CN | 209781195 | U | 12/2019 |
| CN | 116292280 | A | 6/2023 |
| DE | 3917656 | C2 | 11/1995 |
| DE | 102011001394 | A1 | 9/2012 |
| EP | 0256445 | B1 | 5/1992 |
| EP | 0747598 | A2 | 12/1996 |
| EP | 0822335 | A2 | 2/1998 |
| EP | 1067289 | A2 | 1/2001 |
| EP | 1081384 | A2 | 3/2001 |
| EP | 1087142 | A2 | 3/2001 |
| EP | 1182353 | A1 | 2/2002 |
| EP | 1 241 417 | A1 | 9/2002 |
| EP | 0972942 | B1 | 8/2003 |
| EP | 1371851 | A2 | 12/2003 |
| EP | 1382854 | A2 | 1/2004 |
| EP | 2151577 | A1 | 2/2010 |
| EP | 1927755 | A3 | 11/2013 |
| EP | 3961123 | A1 | 3/2022 |
| FR | 2764347 | A1 | 12/1998 |
| GB | 747832 | A | 4/1956 |
| GB | 2107829 | A | 5/1983 |
| JP | S58214689 | A | 12/1983 |
| JP | S60259794 | A | 12/1985 |
| JP | S62220789 | A | 9/1987 |
| JP | S6385277 | A | 4/1988 |
| JP | S63205482 | A | 8/1988 |
| JP | H01178789 | A | 7/1989 |
| JP | H0281982 | A | 3/1990 |
| JP | H02153282 | A | 6/1990 |

(56) References Cited

FOREIGN PATENT DOCUMENTS

| | | | |
|---|---|---|---|
| JP | H03081588 | A | 4/1991 |
| JP | H03233101 | A | 10/1991 |
| JP | H04121478 | A | 4/1992 |
| JP | H04272490 | A | 9/1992 |
| JP | H0610601 | A | 1/1994 |
| JP | H0726618 | B2 | 3/1995 |
| JP | H07293456 | A | 11/1995 |
| JP | H08247053 | A | 9/1996 |
| JP | H08320079 | A | 12/1996 |
| JP | H08334094 | A | 12/1996 |
| JP | H09177689 | A | 7/1997 |
| JP | H11107950 | A | 4/1999 |
| JP | H11166490 | A | 6/1999 |
| JP | 2951752 | B2 | 9/1999 |
| JP | H11324950 | A | 11/1999 |
| JP | 2000104684 | A | 4/2000 |
| JP | 2000161263 | A | 6/2000 |
| JP | 2000329078 | A | 11/2000 |
| JP | 3141949 | B2 | 3/2001 |
| JP | 2002202074 | A | 7/2002 |
| JP | 2003074481 | A | 3/2003 |
| JP | 2003074482 | A | 3/2003 |
| JP | 2003106258 | A | 4/2003 |
| JP | 2003214365 | A | 7/2003 |
| JP | 2003227479 | A | 8/2003 |
| JP | 2004239070 | A | 8/2004 |
| JP | 2005264827 | A | 9/2005 |
| JP | 2006083754 | A | 3/2006 |
| JP | 2006183474 | A | 7/2006 |
| JP | 2007154761 | A | 6/2007 |
| JP | 2007228683 | A | 9/2007 |
| JP | 2008248775 | A | 10/2008 |
| JP | 2008267707 | A | 11/2008 |
| JP | 2013104305 | A | 5/2013 |
| JP | 2013167215 | A | 8/2013 |
| KR | 870000015 | B1 | 1/1987 |
| KR | 10-2001-0009403 | A | 2/2001 |
| KR | 20050027402 | A | 3/2005 |
| KR | 20050095246 | A | 9/2005 |
| KR | 100547323 | B1 | 1/2006 |
| KR | 20100017008 | A | 2/2010 |
| KR | 101009266 | B1 | 1/2011 |
| KR | 20120008045 | A | 1/2012 |
| KR | 20120094212 | A | 8/2012 |
| KR | 101192642 | B1 | 10/2012 |
| KR | 20120115581 | A | 10/2012 |
| KR | 20130011864 | A | 1/2013 |
| KR | 20130094646 | A | 8/2013 |
| KR | 20140114212 | A | 9/2014 |
| KR | 10-2018-0094219 | A | 8/2018 |
| KR | 101917697 | B1 | 11/2018 |
| WO | 9515025 | A1 | 6/1995 |
| WO | 0073659 | A1 | 12/2000 |
| WO | 2007046810 | A2 | 4/2007 |
| WO | 2008060525 | A1 | 5/2008 |
| WO | 2009017741 | A1 | 2/2009 |
| WO | 2009155099 | A2 | 12/2009 |
| WO | 2010118140 | A2 | 10/2010 |
| WO | 2011106422 | A2 | 9/2011 |
| WO | 2012114455 | A1 | 8/2012 |
| WO | 2015187816 | A1 | 12/2015 |
| WO | 2017071641 | A1 | 5/2017 |
| WO | 2019128793 | A1 | 7/2019 |
| WO | 2019165254 | A1 | 8/2019 |
| WO | 2019222535 | A1 | 11/2019 |
| WO | 2020-209979 | A2 | 10/2020 |
| WO | 2021007528 | A1 | 1/2021 |

OTHER PUBLICATIONS

Yanagisawa, M.; Uematsu, T.; Hiodoshi, S.; Saito, M.; and Era, S., "Noise Reduction Technology For Inverter Controlled Scroll Compressors" (2002). International Compressor Engineering Conference. Paper 1578.

Lee, J. K.; Lee, S. J.; Lee, D. S.; Lee, B. C.; and Lee, U. S., "Identification and Reduction of Noise in a Scroll Compressor" (2000). International Compressor Engineering Conference. Paper 1496.

Office Action regarding U.S. Appl. No. 17/835,048, dated Nov. 24, 2023.

Notice of Allowance regarding U.S. Appl. No. 18/115,355 dated Jan. 4, 2024.

Non-Final Office Action regarding U.S. Appl. No. 18/541,828 dated Apr. 3, 2024.

Non-Final Office Action regarding U.S. Appl. No. 18/533,121 dated Apr. 4, 2024.

Non-Final Office Action regarding U.S. Appl. No. 18/394,474 dated Apr. 11, 2024.

International Search Report and Written Opinion regarding Application No. PCT/US2023/086010 dated Apr. 24, 2024.

Final Office Action regarding U.S. Appl. No. 17/835,048 dated May 3, 2024.

Non-Final Office Action regarding U.S. Appl. No. 18/381,884 dated May 10, 2024.

Notice of Allowance regarding U.S. Appl. No. 18/541,828 dated Aug. 12, 2024.

Notice of Allowance regarding U.S. Appl. No. 18/533,121 dated Aug. 14, 2024.

Final Office Action regarding U.S. Appl. No. 18/394,474 dated Aug. 28, 2024.

Non-Final Office Action regarding U.S. Appl. No. 17/830,026 dated Jul. 9, 2024.

Notice of Allowance regarding U.S. Appl. No. 18/381,884 dated Sep. 4, 2024.

Notice of Allowance regarding U.S. Appl. No. 17/830,026 dated Nov. 11, 2024.

Carrier, Optimal Cooling or Optimized Savings?, Mar. 2017.

Khushairi et al, A Study on the Optimization of Control Strategy of a Thermal Energy Storage System for Building Air-Conditioning, 2011.

International Search Report and Written Opinion of the ISA for PCT/US2022/029616, ISA/KR, mailed Aug. 30, 2022.

Non-Final Office Action regarding U.S. Appl. No. 17/324,696 dated Nov. 17, 2022.

Non-Final Office Action regarding U.S. Appl. No. 17/324,696 dated May 22, 2023.

Final Office Action regarding U.S. Appl. No. 17/324,696 dated Nov. 9, 2023.

Chen, Multi-way valve, thermal management system and electric automobile, Dec. 13, 2019, Whole Document (Year: 2019).

Lee, One-piece type multiple unit valve device of water pump for vehicle, English Translation, Oct. 16, 2018, Whole Document (Year: 2018).

Final Office Action regarding U.S. Appl. No. 18/394,474 dated Nov. 21, 2024.

Notice of Allowance regarding U.S. Appl. No. 17/830,026 dated Jan. 13, 2025.

Search Report regarding European Patent Application No. 241933761, dated Feb. 10, 2025.

Notice of Allowance regarding U.S. Appl. No. 18/394,474 dated Mar. 27, 2025.

Search Report regarding European Patent Application No. 228500633, dated Apr. 2, 2025.

Search Report regarding European Patent Application No. 242194223, dated May 30, 2025.

Notice of Allowance regarding U.S. Appl. No. 18/394,474 dated Jul. 25, 2025.

Non-Final Office Action regarding U.S. Appl. No. 18/753,630 dated Aug. 12, 2025.

Search Report regarding European Patent Application No. 242170876, dated Jul. 31, 2025.

Office Action regarding Korean Patent Application No. 1020247002691, Oct. 16, 2025 [Translation provided by Koryo].

Final Office Action regarding U.S. Appl. No. 18/394,474 dated Nov. 21, 2023.

Partial Search Report regarding European Patent Application No. 228053047, dated Feb. 17, 2025.

(56) References Cited

OTHER PUBLICATIONS

Search Report regarding European Patent Application No. 228053047, dated May 9, 2025.
Office Action regarding Korean Patent Application No. 1020237042128, Feb. 10, 2026 [Translation provided by Koryo].
Office Action regarding Chinese Patent Application No. 201811168307.7, dated Mar. 27, 2020. Translation provided by Unitalen Attorneys at Law.
Office Action regarding Korean Patent Application No. 10-2018-0159231, dated Apr. 7, 2020. Translation provided by KS Koryo International IP Law Firm.
Office Action regarding Chinese Patent Application No. 201780055443.2, dated Apr. 14, 2020. Translation provided by Unitalen Attorneys At Law.
Notice of Allowance regarding U.S. Appl. No. 15/682,599, dated Apr. 22, 2020.
Notice of Allowance regarding U.S. Appl. No. 15/831,423, dated May 20, 2020.
Notice of Allowance regarding U.S. Appl. No. 15/692,844, dated Jun. 4, 2020.
Restriction Requirement regarding U.S. Appl. No. 16/147,920, dated Jun. 25, 2020.
Office Action regarding U.S. Appl. No. 16/154,406, dated Jun. 29, 2020.
International Search Report regarding International Application No. PCT/US2020/022030, dated Jul. 2, 2020.
Written Opinion of the International Searching Authority regarding International Application No. PCT/US2020/022030, dated Jul. 2, 2020.
Restriction Requirement regarding U.S. Appl. No. 16/154,844, dated Jul. 2, 2020.
Office Action regarding Chinese Patent Application No. 201811480347.5, dated Jul. 21, 2020. Translation provided by Unitalen Attorneys at Law.
Office Action regarding U.S. Appl. No. 15/881,016, dated Jul. 21, 2020.
Office Action regarding U.S. Appl. No. 16/177,902, dated Jul. 23, 2020.
Office Action regarding U.S. Appl. No. 16/147,920, dated Sep. 25, 2020.
Notice of Allowance regarding U.S. Appl. No. 16/154,406, dated Oct. 2, 2020.
Office Action regarding U.S. Appl. No. 16/154,844, dated Oct. 5, 2020.
Notice of Allowance regarding U.S. Appl. No. 15/881,016, dated Nov. 17, 2020.
Notice of Allowance regarding U.S. Appl. No. 16/177,902, dated Nov. 27, 2020.
Notice of Allowance regarding U.S. Appl. No. 16/147,920, dated Feb. 2, 2021.
Notice of Allowance regarding U.S. Appl. No. 16/154,844, dated Feb. 10, 2021.
Heatcraft RPD; How and Why we use Capacity Control; dated Jan. 17, 2016; 12 Pages.
Non-Final Office Action regarding U.S. Appl. No. 17/176,080 dated Mar. 30, 2022.
First Chinese Office Action & Search Report regarding Application No. 201980040745.1 dated Jan. 6, 2022. English translation provided by Unitalen Attorneys at Law.
Non-Final Office Action regarding U.S. Appl. No. 17/388,923 dated Jun. 9, 2022.
Notice of Allowance regarding U.S. Appl. No. 17/157,588 dated Jun. 16, 2022.
Final Office Action regarding U.S. Appl. No. 17/176,080 dated Aug. 12, 2022.
Advisory Action regarding U.S. Appl. No. 17/176,080 dated Oct. 17, 2022.
Performance of the Use of Plastics in Oil-Free Scroll Compressors, Shaffer et al., 2012.
Notice of Allowance regarding U.S. Appl. No. 17/176,080 dated Dec. 15, 2022.
Corrected Notice of Allowance regarding U.S. Appl. No. 17/176,080 dated Dec. 21, 2022.
Notice of Allowance regarding U.S. Appl. No. 17/176,080 dated Feb. 8, 2023.
Office Action mailed Jan. 19, 2023, in U.S. Appl. No. 17/196,119.
Office Action mailed Mar. 9, 2023, in U.S. Appl. No. 17/835,048.
Notice of Allowance regarding U.S. Appl. No. 17/196,119 dated Apr. 26, 2023.
Non-Final Office Action regarding U.S. Appl. No. 17/886,047 dated May 17, 2023.
Non-Final Office Action regarding U.S. Appl. No. 17/980,798 dated May 24, 2023.
Office Action regarding Chinese Patent Application No. 2022109807542, dated May 15, 2023. Translation provided by Unitalen Attorneys at Law.
Office Action regarding European Patent Application No. 198040792, dated Jun. 13, 2023.
Notice of Allowance regarding U.S. Appl. No. 17/866,047 dated Aug. 18, 2023.
Notice of Allowance regarding U.S. Appl. No. 17/980,798 dated Sep. 20, 2023.
Final Office Action regarding U.S. Appl. No. 17/835,048 dated Aug. 10, 2023.
International Search Report and Written Opinion regarding App. No. PCT/US2023/023852 dated Sep. 20, 2023.
International Search Report and Written Opinion in corresponding Application No. PCT/US2023/029860 dated Nov. 21, 2023.
Non-Final Office Action for U.S. Appl. No. 18/115,355 dated Jul. 18, 2023.
International Search Report Regarding Application PCT/US2023/015116-WO-POA Dated Sep. 5, 2023.
International Search Report and Written Opinion in corresponding Application No. PCT/US2022/033029 dated Dec. 6, 2022.
International Search Report and Written Opinion regarding Application No. PCT/US2023/029860 dated Nov. 21, 2023.
Liegeois, Olivier and Winandy, Eric, "Scroll Compressors for Dedicated Heat Pumps: Development and Performance Comparison" (2008). International Compressor Engineering Conference. Paper 1906.
Itoh, T.; Fujitani, M.; and Takeda, K., "Investigation of Discharge Flow Pulsation in Scroll Crompressors" (1994). International Compressor Engineering Conference. Paper 1056.
Advisory Action regarding U.S. Appl. No. 14/073,293, dated Apr. 18, 2016.
Office Action regarding Chinese Patent Application No. 201380062657.4, dated May 4, 2016. Translation provided by Unitalen Attorneys at Law.
Office Action regarding Chinese Patent Application No. 201380059963.2, dated May 10, 2016. Translation provided by Unitalen Attorneys at Law.
Office Action regarding U.S. Appl. No. 14/060,102, dated Jun. 14, 2016.
Office Action regarding U.S. Appl. No. 14/846,877, dated Jul. 15, 2016.
Office Action regarding Chinese Patent Application No. 201410461048.2, dated Jul. 26, 2016. Translation provided by Unitalen Attorneys at Law.
Search Report regarding European Patent Application No. 13858194.7, dated Aug. 3, 2016.
Search Report regarding European Patent Application No. 13859308.2, dated Aug. 3, 2016.
Office Action regarding U.S. Appl. No. 14/294,458, dated Aug. 19, 2016.
Office Action regarding Chinese Patent Application No. 201410460792.0, dated Oct. 21, 2016. Translation provided by Unitalen Attorneys At Law.
Search Report regarding European Patent Application No. 11747996.4, dated Nov. 7, 2016.
Office Action regarding Chinese Patent Application No. 201380059666.8, dated Nov. 23, 2016. Translation provided by Unitalen Attorneys at Law.

(56) References Cited

OTHER PUBLICATIONS

Office Action regarding U.S. Appl. No. 14/060,102, dated Dec. 28, 2016.
International Search Report regarding International Application No. PCT/CN2016/103763, dated Jan. 25, 2017.
Written Opinion of the International Searching Authority regarding International Application No. PCT/CN2016/103763, dated Jan. 25, 2017.
Office Action regarding U.S. Appl. No. 15/156,400, dated Feb. 23, 2017.
Office Action regarding U.S. Appl. No. 14/294,458, dated Feb. 28, 2017.
Advisory Action regarding U.S. Appl. No. 14/060,102, dated Mar. 3, 2017.
Office Action regarding U.S. Appl. No. 14/663,073, dated Apr. 11, 2017.
Office Action regarding Chinese Patent Application No. 201410460792.0, dated Apr. 24, 2017. Translation provided by Unitalen Attorneys at Law.
Office Action regarding U.S. Appl. No. 14/946,824, dated May 10, 2017.
Advisory Action regarding U.S. Appl. No. 14/294,458, dated Jun. 9, 2017.
Office Action regarding Chinese Patent Application No. 201610703191.7, dated Jun. 13, 2017. Translation provided by Unitalen Attorneys at Law.
Office Action regarding Chinese Patent Application No. 201610516097.0, dated Jun. 27, 2017. Translation provided by Unitalen Attorneys at Law.
Office Action regarding Indian Patent Application No. 2043/MUMNP/2011, dated Jul. 28, 2017.
Restriction Requirement regarding U.S. Appl. No. 14/809,786, dated Aug. 16, 2017.
Office Action regarding U.S. Appl. No. 14/294,458, dated Sep. 21, 2017.
Office Action regarding U.S. Appl. No. 14/757,407, dated Oct. 13, 2017.
Office Action regarding Chinese Patent Application No. 201610158216.X, dated Oct. 30, 2017. Translation provided by Unitalen Attorneys at Law.
Office Action regarding Chinese Patent Application No. 201410460792.0, dated Nov. 1, 2017. Translation provided by Unitalen Attorneys At Law.
Office Action regarding Chinese Patent Application No. 201610512702.7, dated Dec. 20, 2017. Partial translation provided by Unitalen Attorneys at Law.
International Search Report regarding International Application No. PCT/US2017/050525, dated Dec. 28, 2017.
Written Opinion of the International Searching Authority regarding International Application No. PCT/US2017/050525, dated Dec. 28, 2017.
Office Action regarding Chinese Patent Application No. 201610499158.7, dated Jan. 9, 2018. Translation provided by Unitalen Attorneys at Law.
Office Action regarding U.S. Appl. No. 14/809,786, dated Jan. 11, 2018.
Office Action regarding Chinese Patent Application No. 201580029636.1, dated Jan. 17, 2018. Translation provided by Unitalen Attorneys at Law.
Office Action regarding Chinese Patent Application No. 201580041209.5, dated Jan. 17, 2018. Translation provided by Unitalen Attorneys at Law.
Office Action regarding U.S. Appl. No. 15/646,654, dated Feb. 9, 2018.
Office Action regarding U.S. Appl. No. 15/651,471, dated Feb. 23, 2018.
Office Action regarding Indian Patent Application No. 1907/MUMNP/2012, dated Feb. 26, 2018.
Restriction Requirement regarding U.S. Appl. No. 15/186,092, dated Apr. 3, 2018.
Restriction Requirement regarding U.S. Appl. No. 15/784,458, dated Apr. 5, 2018.
Office Action regarding Korean Patent Application No. 10-2016-7034539, dated Apr. 11, 2018. Translation provided by Y.S. Chang & Associates.
Office Action regarding U.S. Appl. No. 15/186,151, dated May 3, 2018.
Office Action regarding Chinese Patent Application No. 201610930347.5, dated May 14, 2018. Translation provided by Unitalen Attorneys at Law.
Restriction Requirement regarding U.S. Appl. No. 15/187,225, dated May 15, 2018.
Notice of Allowance regarding U.S. Appl. No. 14/757,407, dated May 24, 2018.
Office Action regarding Chinese Patent Application No. 201610158216.X, dated Jun. 13, 2018. Translation provided by Unitalen Attorneys at Law.
Office Action regarding European Patent Application No. 13859308.2, dated Jun. 22, 2018.
Office Action regarding U.S. Appl. No. 15/186,092, dated Jun. 29, 2018.
Notice of Allowance regarding U.S. Appl. No. 15/646,654, dated Jul. 11, 2018.
Notice of Allowance regarding U.S. Appl. No. 15/651,471, dated Jul. 11, 2018.
Office Action regarding U.S. Appl. No. 15/784,540, dated Jul. 17, 2018.
Office Action regarding U.S. Appl. No. 15/784,458, dated Jul. 19, 2018.
Restriction Requirement regarding U.S. Appl. No. 15/587,735, dated Jul. 23, 2018.
Office Action regarding Chinese Patent Application No. 201610499158.7, dated Aug. 1, 2018. Translation provided by Unitalen Attorneys at Law.
Interview Summary regarding U.S. Appl. No. 15/186,092, dated Aug. 14, 2018.
Office Action regarding U.S. Appl. No. 15/187,225, dated Aug. 27, 2018.
Office Action regarding Chinese Patent Application No. 201710795228.8, dated Sep. 5, 2018. Translation provided by Unitalen Attorneys at Law.
Office Action regarding Korean Patent Application No. 10-2016-7034539, dated Sep. 6, 2018. Translation provided by Y.S. Chang & Associates.
Office Action regarding Indian Patent Application No. 1307/MUMNP/2015, dated Sep. 12, 2018.
Office Action regarding Chinese Patent Application No. 201580029636.1, dated Oct. 8, 2018. Translation provided by Unitalen Attorneys at Law.
Office Action regarding U.S. Appl. No. 15/587,735, dated Oct. 9, 2018.
Office Action regarding U.S. Appl. No. 15/186,151, dated Nov. 1, 2018.
Office Action regarding Korean Patent Application No. 10-2017-7033995, dated Nov. 29, 2018. Translation provided by KS Koryo International IP Law Firm.
Notice of Allowance regarding U.S. Appl. No. 15/186,092, dated Dec. 20, 2018.
Office Action regarding Indian Patent Application No. 1306/MUMNP/2015, dated Dec. 31, 2018.
Notice of Allowance regarding U.S. Appl. No. 15/187,225, dated Jan. 3, 2019.
Office Action regarding Chinese Patent Application No. 201610499158.7, dated Feb. 1, 2019. Translation provided by Unitalen Attorneys at Law.
Notice of Allowance regarding U.S. Appl. No. 15/784,458, dated Feb. 7, 2019.
Notice of Allowance regarding U.S. Appl. No. 15/784,540, dated Feb. 7, 2019.
Search Report regarding European Patent Application No. 18198310.7, dated Feb. 27, 2019.
Notice of Allowance regarding U.S. Appl. No. 15/186,151, dated Mar. 19, 2019.

(56) References Cited

OTHER PUBLICATIONS

Notice of Allowance regarding U.S. Appl. No. 15/186,092, dated Apr. 19, 2019.
Office Action regarding Chinese Patent Application No. 201710795228.8, dated Apr. 29, 2019. Translation provided by Unitalen Attorneys at Law.
Notice of Allowance regarding U.S. Appl. No. 15/187,225, dated May 2, 2019.
Office Action regarding U.S. Appl. No. 15/587,735, dated May 17, 2019.
Office Action regarding Chinese Patent Application No. 201811011292.3, dated Jun. 21, 2019. Translation provided by Unitalen Attorneys at Law.
Office Action regarding European Patent Application No. 11747996.4, dated Jun. 26, 2019.
Notice of Allowance regarding U.S. Appl. No. 15/186,151, dated Jul. 25, 2019.
Office Action regarding Chinese Patent Application No. 201610499158.7, dated Aug. 1, 2019. Translation provided by Unitalen Attorneys at Law.
Office Action regarding Chinese Patent Application No. 201811168307.7, dated Aug. 12, 2019. Translation provided by Unitalen Attorneys at Law.
Restriction Requirement regarding U.S. Appl. No. 15/682,599, dated Aug. 14, 2019.
Notice of Allowance regarding U.S. Appl. No. 15/587,735, dated Aug. 23, 2019.
International Search Report regarding International Application No. PCT/US2019/032718, dated Aug. 23, 2019.
Written Opinion of the International Searching Authority regarding International Application No. PCT/US2019/032718, dated Aug. 23, 2019.
Office Action regarding Chinese Patent Application No. 201780055443.2, dated Sep. 2, 2019. Translation provided by Unitalen Attorneys at Law.
Office Action regarding U.S. Appl. No. 15/692,844, dated Sep. 20, 2019.
Office Action regarding Chinese Patent Application No. 201710795228.8, dated Oct. 28, 2019. Translation provided by Unitalen Attorneys at Law.
Office Action regarding European Patent Application No. 11747996.4, dated Nov. 5, 2019.
Notice of Allowance regarding U.S. Appl. No. 15/186,151, dated Nov. 14, 2019.
Office Action regarding Indian Patent Application No. 2043/MUMNP/2011, dated Nov. 27, 2019.
Office Action regarding Chinese Patent Application No. 201811480347.5, dated Jan. 10, 2020. Translation provided by Unitalen Attorneys at Law.
Office Action regarding Chinese Patent Application No. 201811541653.5, dated Jan. 10, 2020. Translation provided by Unitalen Attorneys at Law.
Office Action regarding European Patent Application No. 11747996.4, dated Jan. 14, 2020.
Office Action regarding U.S. Appl. No. 15/881,016, dated Jan. 23, 2020.
Office Action regarding U.S. Appl. No. 15/682,599, dated Jan. 24, 2020.
Office Action regarding U.S. Appl. No. 15/831,423, dated Jan. 31, 2020.
Notice of Allowance regarding U.S. Appl. No. 15/692,844, dated Feb. 20, 2020.
Office Action regarding European Patent Application No. 13859308.2, dated Mar. 4, 2020.
Luckevich, Mark, "MEMS microvalves: the new valve world." Valve World, May 2007, pp. 79-83.
Office Action regarding U.S. Appl. No. 11/522,250, dated Aug. 1, 2007.
Search Report regarding European Patent Application No. 07254962.9, dated Mar. 12, 2008.
Office Action regarding Chinese Patent Application No. 200710153687.2, dated Mar. 6, 2009. Translation provided by CCPIT Patent and Trademark Law Office.
Office Action regarding U.S. Appl. No. 12/103,265, dated May 27, 2009.
Office Action regarding U.S. Appl. No. 11/645,288, dated Nov. 30, 2009.
Office Action regarding U.S. Appl. No. 12/103,265, dated Dec. 17, 2009.
Office Action regarding Korean Patent Application No. 10-2007-0093478, dated Feb. 25, 2010. Translation provided by Y.S. Chang & Associates.
Office Action regarding U.S. Appl. No. 12/103,265, dated Jun. 15, 2010.
Office Action regarding Chinese Patent Application No. 200710160038.5, dated Jul. 8, 2010. Translation provided by Unitalen Attorneys At Law.
Office Action regarding Korean Patent Application No. 10-2007-0093478, dated Aug. 31, 2010. Translation provided by Y.S. Chang & Associates.
Advisory Action regarding U.S. Appl. No. 12/103,265, dated Sep. 17, 2010.
International Search Report regarding International Application No. PCT/US2010/030248, dated Nov. 26, 2010.
Written Opinion of the International Searching Authority regarding International Application No. PCT/US2010/030248, dated Nov. 26, 2010.
International Search Report regarding International Application No. PCT/US2011/025921, dated Oct. 7, 2011.
Written Opinion of the International Search Authority regarding International Application No. PCT/US2011/025921, dated Oct. 7, 2011.
Office Action regarding Chinese Patent Application No. 200710160038.5, dated Jan. 31, 2012. Translation provided by Unitalen Attorneys At Law.
Office Action regarding Chinese Patent Application No. 201010224582.3, dated Apr. 17, 2012. Translation provided by Unitalen Attorneys at Law.
Office Action regarding Indian Patent Application No. 1071/KOL/2007, dated Apr. 27, 2012.
Office Action regarding U.S. Appl. No. 13/036,529, dated Aug. 22, 2012.
Office Action regarding U.S. Appl. No. 13/181,065, dated Nov. 9, 2012.
International Search Report regarding International Application No. PCT/US2013/051678, dated Oct. 21, 2013.
Written Opinion of the International Searching Authority regarding International Application No. PCT/US2013/051678, dated Oct. 21, 2013.
Office Action regarding Chinese Patent Application No. 201080020243.1, dated Nov. 5, 2013. Translation provided by Unitalen Attorneys At Law.
International Search Report regarding International Application No. PCT/US2013/069456, dated Feb. 18, 2014.
Written Opinion of the International Searching Authority regarding International Application No. PCT/US2013/069456, dated Feb. 18, 2014.
International Search Report regarding International Application No. PCT/US2013/069462, dated Feb. 21, 2014.
Written Opinion of the International Searching Authority regarding International Application No. PCT/US2013/069462, dated Feb. 21, 2014.
International Search Report regarding International Application No. PCT/US2013/070992, dated Feb. 25, 2014.
Written Opinion of the International Searching Authority regarding International Application No. PCT/US2013/070992, dated Feb. 25, 2014.
International Search Report regarding International Application No. PCT/US2013/070981, dated Mar. 4, 2014.
Written Opinion of the International Searching Authority regarding International Application No. PCT/US2013/070981, dated Mar. 4, 2014.

(56) References Cited

OTHER PUBLICATIONS

Office Action regarding Chinese Patent Application No. 201180010366.1, dated Jun. 4, 2014. Translation provided by Unitalen Attorneys at Law.
Office Action regarding Chinese Patent Application No. 201180010366.1, dated Dec. 31, 2014. Translation provided by Unitalen Attorneys At Law.
Office Action regarding U.S. Appl. No. 14/081,390, dated Mar. 27, 2015.
Search Report regarding European Patent Application No. 10762374.6, dated Jun. 16, 2015.
Office Action regarding U.S. Appl. No. 14/060,240, dated Aug. 12, 2015.
International Search Report regarding International Application No. PCT/US2015/033960, dated Sep. 1, 2015.
Written Opinion of the International Searching Authority regarding International Application No. PCT/US2015/033960, dated Sep. 1, 2015.
Office Action regarding U.S. Appl. No. 14/073,293, dated Sep. 25, 2015.
Restriction Requirement regarding U.S. Appl. No. 14/060,102, dated Oct. 7, 2015.
International Search Report regarding International Application No. PCT/US2015/042479, dated Oct. 23, 2015.
Written Opinion of the International Searching Authority regarding International Application No. PCT/US2015/042479, dated Oct. 23, 2015.
Office Action regarding Chinese Patent Application No. 201410461048.2, dated Nov. 30, 2015. Translation provided by Unitalen Attorneys at Law.
Notice of Allowance regarding U.S. Appl. No. 14/060,240, dated Dec. 1, 2015.
Office Action regarding U.S. Appl. No. 14/073,293, dated Jan. 29, 2016.
Office Action regarding Chinese Patent Application No. 201410460792.0, dated Feb. 25, 2016. Translation provided by Unitalen Attorneys at Law.
Restriction Requirement regarding U.S. Appl. No. 14/060,102, dated Mar. 16, 2016.
Office Action regarding Chinese Patent Application No. 201380059666.8, dated Apr. 5, 2016. Translation provided by Unitalen Attorneys At Law.
Office Action regarding Chinese Patent Application No. 201380062614.6, dated Apr. 5, 2016. Translation provided by Unitalen Attorneys At Law.
363 Adjustable Angle Base Flange, Kee Klamp, Simplified Building 2025.

* cited by examiner

SCROLL COMPRESSOR WITH VAPOR INJECTION

FIELD

The present disclosure relates to a scroll compressor, and more particularly, to a scroll compressor with vapor injection.

BACKGROUND

This section provides background information related to the present disclosure and is not necessarily prior art.

A climate-control system such as, for example, a heat pump system, a refrigeration system, or an air conditioning system, may include a fluid circuit having an outdoor heat exchanger, an indoor heat exchanger, an expansion device disposed between the indoor and outdoor heat exchangers, and one or more compressors circulating a working fluid (e.g., a refrigerant) between the indoor and outdoor heat exchangers. Efficient and reliable operation of the one or more compressors is desirable to ensure that the climate-control system in which the one or more compressors are installed is capable of effectively and efficiently providing a cooling and/or heating effect on demand. The system of the present disclosure may include an economizer and vapor-injection conduit that can provide intermediate-pressure working fluid to the compressor via a vapor-injection fitting. The vapor-injection fitting is configured to facilitate assembly of the compressor while maintaining or improving performance of the compressor.

SUMMARY

This section provides a general summary of the disclosure and is not a comprehensive disclosure of its full scope or all its features.

In one example, the present disclosure provides a compressor that includes a shell, an end cap, a first scroll, a second scroll, and a first fitting member. The end cap extends from an end of the shell. The first scroll is disposed within the shell and includes a first end plate and a first spiral wrap extending from the first end plate. The second scroll is disposed at least partially within the shell and includes a second end plate and a second spiral wrap extending from the second end plate. The first and second spiral wraps cooperate to define fluid pockets therebetween. The fluid pockets are movable from a radially outer position, a radially intermediate position, and a radially inner position. The second end plate includes a capacity-modulation passage in fluid communication with one or more of the fluid pockets at the radially intermediate position(s). The first fitting member includes a first mounting surface mounted to a second mounting surface of the second scroll. The first and second mounting surfaces are disposed at an angle relative to a longitudinal axis of the shell.

In some configurations, the compressor of the above paragraph includes a fastener extending through an aperture in the first fitting member and into an aperture in the second mounting surface. The shaft of the fastener may extend in a direction perpendicular to the first and second mounting surfaces.

In some configurations of the compressor of either or both above paragraphs, a longitudinal axis of a shaft of the fastener extends out of the shell without intersecting the shell.

In some configurations of the compressor of any one or more of the above paragraphs, the first and second mounting surfaces are disposed at a non-perpendicular angle relative to the longitudinal axis of the shell.

In some configurations of the compressor of any one or more of the above paragraphs, the first fitting member includes a body and a flange extending from an end of the body.

In some configurations of the compressor of any one or more of the above paragraphs, the first fitting member includes a passage that extends through the body and the flange.

In some configurations of the compressor of any one or more of the above paragraphs, the passage in the first fitting member is in fluid communication with the capacity-modulation passage.

In some configurations of the compressor of any one or more of the above paragraphs, the flange defines the first mounting surface.

In some configurations of the compressor of any one or more of the above paragraphs, the passage of the first fitting member includes a first portion and a second portion that is perpendicular to the first portion.

In some configurations of the compressor of any one or more of the above paragraphs, the first and second mounting surfaces are disposed at non-perpendicular angles relative to the first and second portions.

In some configurations, the compressor of any one or more of the above paragraphs includes a gasket disposed between and sealingly engaging the first and second mounting surfaces.

In some configurations, the compressor of any one or more of the above paragraphs includes a second fitting member in fluid communication with the first fitting member. In some configurations, the second fitting member extends through an opening in the shell.

In some configurations, the compressor of any one or more of the above paragraphs includes a connecting conduit in fluid communication with the first and second fitting members.

In some configurations of the compressor of any one or more of the above paragraphs, the connecting conduit is received within the passage in the first fitting member and is received within a passage in the second fitting member.

In some configurations of the compressor of any one or more of the above paragraphs, the first scroll member is an orbiting scroll, and the second scroll member is a non-orbiting scroll.

In some configurations, the compressor of any one or more of the above paragraphs includes a modulation valve ring engaging the second scroll and configured to selectively block the capacity-modulation passage.

In another example, the present disclosure provides a compressor that includes a shell, an end cap, first and second scrolls, and a first fitting member. The end cap extends from an end of the shell. The first scroll is disposed within the shell and includes a first end plate and a first spiral wrap extending from the first end plate. The second scroll is disposed at least partially within the shell and includes a second end plate and a second spiral wrap extending from the second end plate. The first and second spiral wraps cooperate to define fluid pockets therebetween. The fluid pockets are movable from a radially outer position, a radially intermediate position, and a radially inner position. The second end plate includes a capacity-modulation passage in fluid communication with one or more of the fluid pockets at the radially intermediate position(s). The first fitting member includes a first mounting surface mounted to a second mounting surface of the second scroll. The first and second mounting surfaces are disposed at a non-perpendicular angle relative to a longitudinal axis of the shell. The first fitting member includes a passage in fluid communication with the capacity-modulation passage.

In some configurations of the compressor of the above paragraph, a fastener extending through an aperture in the first fitting member and into an aperture in the second mounting surface.

In some configurations of the compressor of either or both of the above paragraphs, a shaft of the fastener extends in a direction perpendicular to the first and second mounting surfaces.

In some configurations of the compressor of any one or more of the above paragraphs, a longitudinal axis of a shaft of the fastener extends out of the shell without intersecting the shell.

In some configurations of the compressor of any one or more of the above paragraphs, the first fitting member includes a body and a flange extending from an end of the body.

In some configurations of the compressor of any one or more of the above paragraphs, the first fitting member includes a passage that extends through the body and the flange.

In some configurations of the compressor of any one or more of the above paragraphs, the flange defines the first mounting surface.

In some configurations of the compressor of any one or more of the above paragraphs, the passage of the first fitting member includes a first portion and a second portion that is perpendicular to the first portion.

In some configurations of the compressor of any one or more of the above paragraphs, the first and second mounting surfaces are disposed at non-perpendicular angles relative to the first and second portions.

In some configurations, the compressor of any one or more of the above paragraphs includes a second fitting member in fluid communication with the first fitting member.

In some configurations of the compressor of any one or more of the above paragraphs, the second fitting member extends through an opening in the shell.

In some configurations, the compressor of any one or more of the above paragraphs includes a connecting conduit in fluid communication with the first and second fitting members.

In some configurations of the compressor of any one or more of the above paragraphs, the connecting conduit is received within the passage in the first fitting member and is received within a passage in the second fitting member.

In some configurations, the compressor of any one or more of the above paragraphs includes a gasket disposed between and sealingly engaging the first and second mounting surfaces.

In some configurations of the compressor of any one or more of the above paragraphs, the first scroll member is an orbiting scroll, and the second scroll member is a non-orbiting scroll.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The drawings described herein are for illustrative purposes only of selected embodiments and not all possible implementations and are not intended to limit the scope of the present disclosure.

Corresponding reference numerals indicate corresponding parts throughout the several views of the drawings.

DETAILED DESCRIPTION

Figure 1:
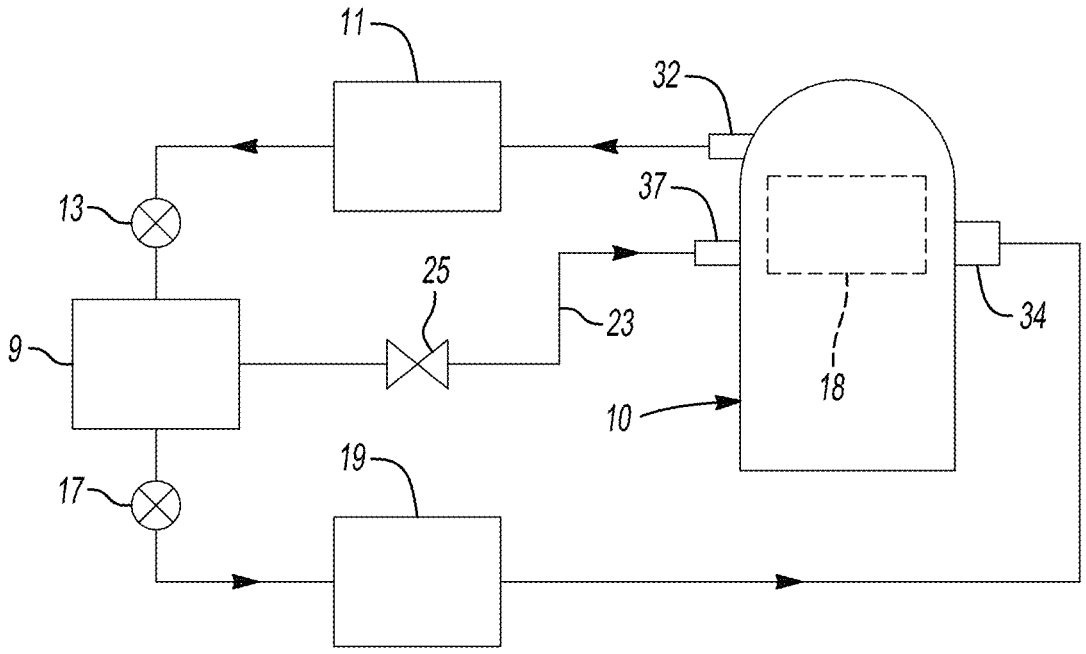
FIG. 1 is a schematic representation of a climate-control system having a compressor according to the principles of the present disclosure.

Example embodiments will now be described more fully with reference to the accompanying drawings.

Example embodiments are provided so that this disclosure will be thorough and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected, or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer, or section. Terms such as "first," "second," and other numerical terms when used herein do not imply a sequence or order unless clearly indicated by the context. Thus, a first element, component, region, layer, or section discussed below could be termed a second element, component, region, layer, or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

FIG. 1 depicts a climate-control system that may include compressor 10, an outdoor heat exchanger (e.g., a condenser) 11, a first expansion device (e.g., an expansion valve or capillary tube) 13, a flash tank or an economizer 9, a second expansion device (e.g., an expansion valve or capillary tube) 17, and an indoor heat exchanger (e.g., an evaporator) 19. During operation of the system, the compressor 10 may compress working fluid (e.g., refrigerant) and discharge the compressed working fluid from the compressor 10 through a discharge fitting 32. The compressed working fluid may flow from the discharge fitting 32 to the outdoor heat exchanger 11, where heat from the working fluid may be transferred to ambient air (or to another cooling fluid). From the outdoor heat exchanger 11, the working fluid may flow through the first expansion device 13, where the pressure of the working fluid is reduced.

From the first expansion device 13, the working fluid may flow into the flash tank 9. A first portion of the fluid in the flash tank 9 (e.g., vapor working fluid) may flow through a fluid-injection conduit 23 that may be coupled to a fluid-injection inlet fitting 37 of the compressor 10. The fluid-injection inlet fitting 37 may be in fluid communication with one or more intermediate-pressure compression pockets (i.e., pockets that are at a pressure between suction and discharge pressures) of a compression mechanism 18 of the compressor 10. A control valve 25 (e.g., a solenoid valve) may control fluid flow through the fluid-injection conduit 23.

A second portion of the fluid in the flash tank 9 (e.g., liquid working fluid) may flow through the second expansion device 17, wherein its pressure is further reduced. From the second expansion device 17, the working fluid may flow through the indoor heat exchanger 19, where the working fluid may absorb heat from a space to be cooled. From the indoor heat exchanger 19, the working fluid may flow back into the compressor 10 through a suction gas inlet fitting 34.

Referring now to FIGS. 2-5, the compressor 10 will be described in detail. The compressor 10 may include a hermetic shell assembly 12, a first bearing housing assembly 14, a second bearing housing assembly 15, a motor assembly 16, the compression mechanism 18, a floating seal assembly 20, and a capacity modulation assembly 22. The shell assembly 12 may generally form a compressor housing and may include a cylindrical shell 21, an end cap 24 at the upper end of the shell 21, a transversely extending partition 26, and a base 28 at a lower end of the shell 21. The end cap 24 and partition 26 may generally define a discharge chamber 30. The discharge fitting 32 (FIG. 1) may be attached to the shell assembly 12 at an opening in the end cap 24. The suction gas inlet fitting 34 may be attached to the shell assembly 12 at another opening and may communicate with a suction chamber 35 defined by the shell 21 and the partition 26. The partition 26 may include a discharge passage 36 that provides fluid communication between the compression mechanism 18 (which is disposed in the suction chamber 35) and the discharge chamber 30.

The first bearing housing assembly 14 may be affixed to the shell 21 and may include a first bearing housing 38 and a first bearing 40. The first bearing housing 38 may house the first bearing 40 therein and may define an annular flat thrust bearing surface 42 on an axial end surface thereof. The second bearing housing assembly 15 may be affixed to the shell 21 and may include a second bearing housing 39 and a second bearing 41. The second bearing housing 39 may house the second bearing 41 therein.

The motor assembly 16 may include a motor stator 44 and a rotor 46. The motor stator 44 may be attached to the shell 21 (e.g., via press fit, staking, welding, and/or a stator housing). The rotor 46 may be attached to a driveshaft 48 (e.g., via press fit, staking, and/or welding). The driveshaft 48 may be driven by the rotor 46 and may be supported by the first and second bearings 40, 41 for rotation relative to the shell assembly 12. In some configurations, the motor assembly 16 is a variable-speed motor. In other configurations, the motor assembly 16 could be a multi-speed motor or a fixed-speed motor.

The compression mechanism 18 may include an orbiting scroll 52, a non-orbiting scroll 54 and an Oldham coupling 56. The orbiting scroll 52 may include an end plate 58 having a spiral wrap 60 on the upper surface thereof and an annular flat thrust surface 62 on the lower surface. The thrust surface 62 may interface with the annular flat thrust bearing surface 42 on the first bearing housing 38. A cylindrical hub 64 may project downwardly from the thrust surface 62 and may have a drive bushing rotatably disposed therein. A drive bearing may be disposed within the hub 64 and may surround the drive bushing. The drive bushing may include an inner bore in which an eccentric crankpin of the driveshaft 48 is drivingly disposed. A flat surface of the crankpin may drivingly engage a flat surface in a portion of the inner bore of the drive bushing to provide a radially compliant driving arrangement. The Oldham coupling 56 may be engaged with the orbiting and non-orbiting scrolls 52, 54 or with the orbiting scroll 52 and the first bearing housing 38 to prevent relative rotation therebetween.

The non-orbiting scroll 54 may include an end plate 68 and a spiral wrap 70 projecting downwardly from the end plate 68. The spiral wrap 70 may meshingly engage the spiral wrap 60 of the orbiting scroll 52, thereby creating a series of moving compression pockets. The compression pockets defined by the spiral wraps 60, 70 may decrease in volume as they move from a radially outer position (at a suction pressure) to a radially intermediate position (at an intermediate pressure higher than suction pressure) to a radially inner position (at a discharge pressure higher than intermediate pressure) throughout a compression cycle of the compression mechanism 18.

Figure 2:
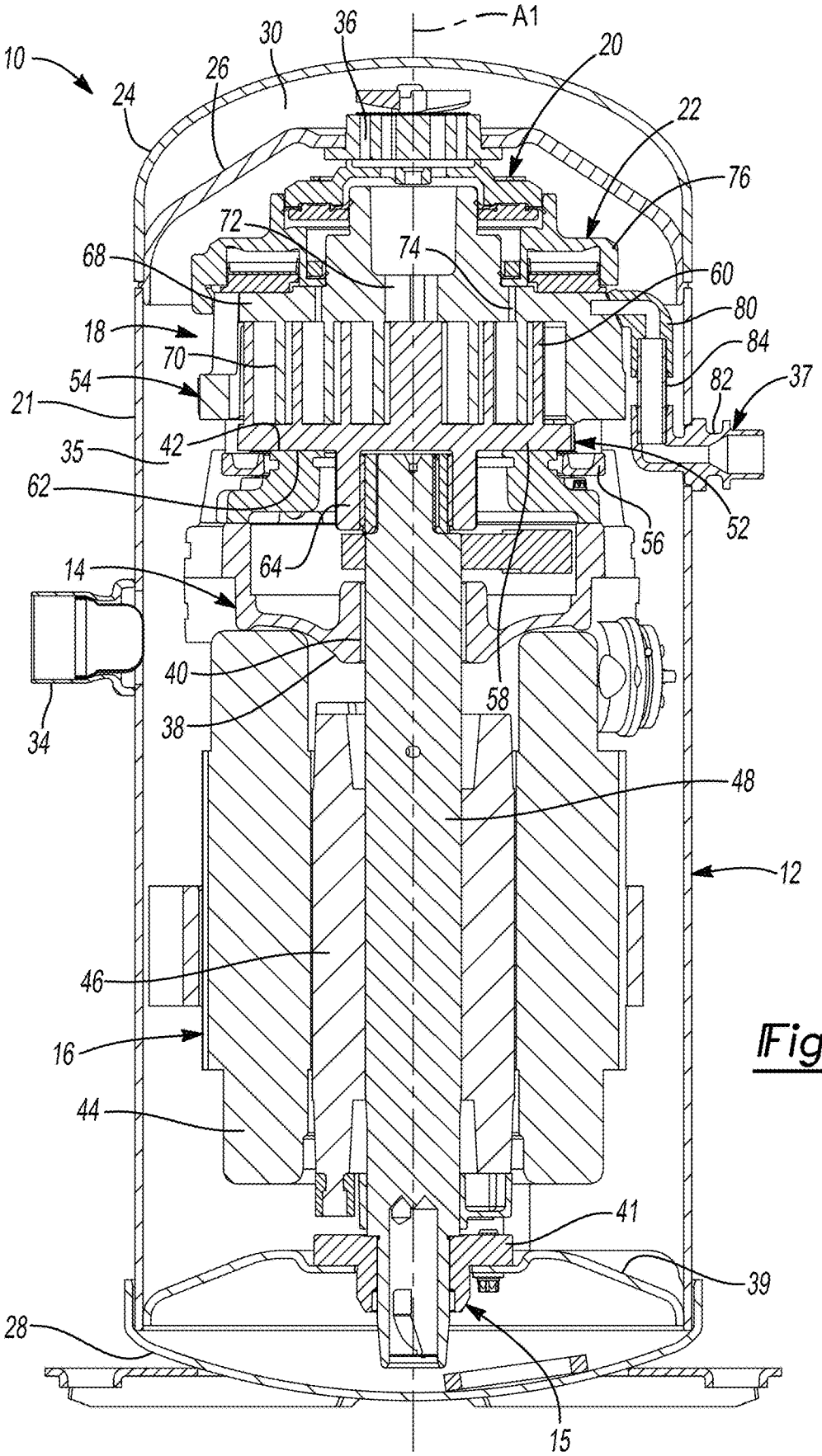
FIG. 2 is a cross-sectional view of the compressor of FIG. 1.
Figure 3:
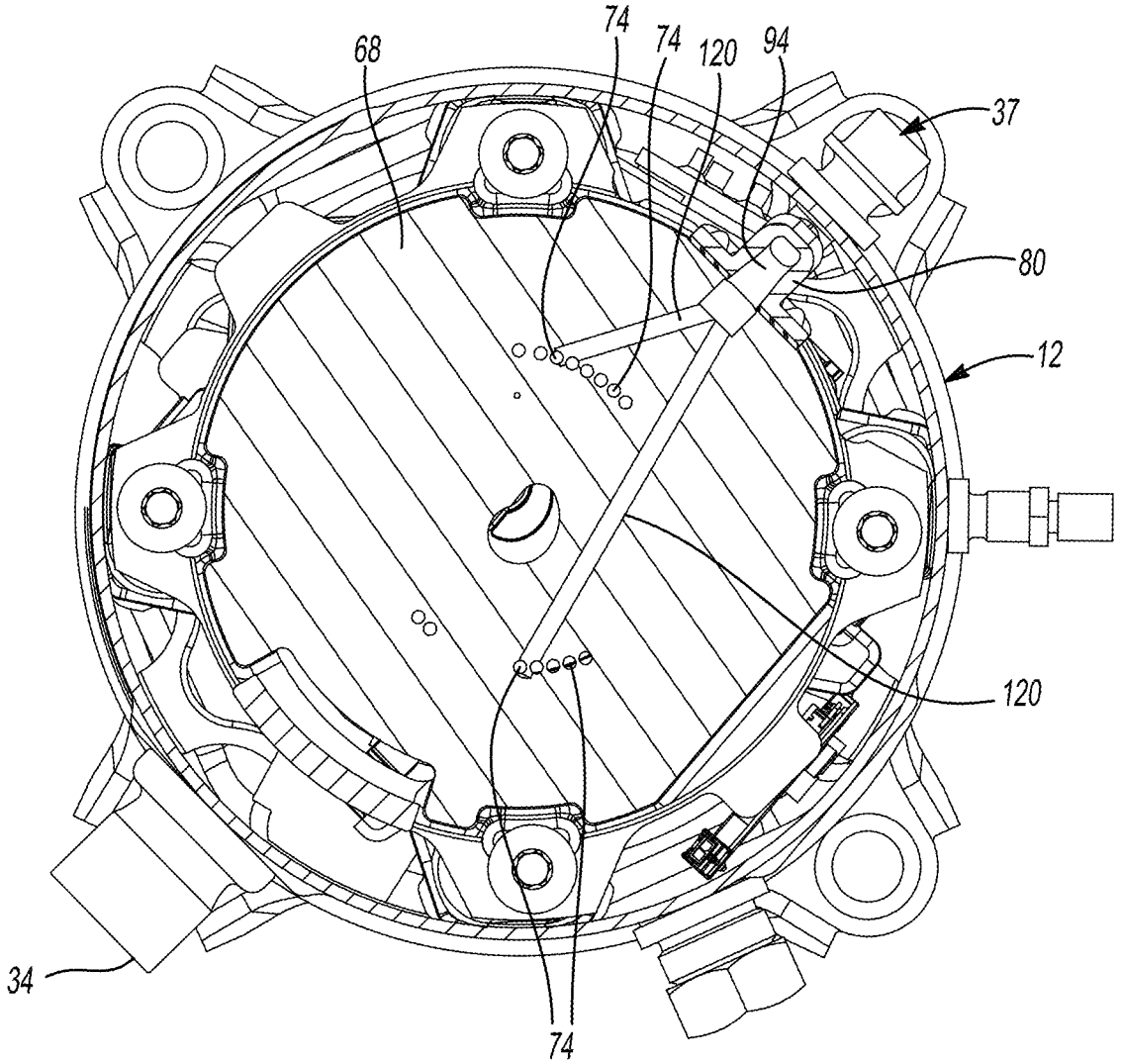
FIG. 3 is another cross-sectional view of the compressor.

The end plate 68 may include a discharge passage 72 (FIG. 2) and a plurality of capacity-modulation passages 74 (FIG. 3). The discharge passage 72 is in communication with fluid pockets at the radially inner position and allows compressed working fluid (e.g., at the discharge pressure) to flow into the discharge chamber 30.

The capacity modulation assembly 22 may include a modulation valve ring 76 that may be movable between open and closed positions to selectively allow working fluid in fluid pockets at radially intermediate positions to be vented to the suction chamber 35 to reduce the capacity of the compressor 10. In some configurations, one or more valves may control movement of the modulation valve ring 76 between the open and closed positions.

The fluid-injection inlet fitting 37 may provide fluid communication between the fluid-injection conduit 23 (FIG. 1) and one or more of the capacity-modulation passages 74 (FIG. 3). While the figures show the inlet fitting 37 providing fluid communication to passages 74 that are also used to vent fluid pockets (i.e., when the modulation valve ring 76 is open), in some configurations of the compressor 10, the inlet fitting 37 may communicate with passages that are separate and distinct from passages used to vent fluid from the fluid pockets. In some configurations, the compressor 10 may not include any passages for venting fluid from the fluid pockets.

The fluid-injection inlet fitting 37 may include a first fitting member 80, a second fitting member 82, and a connecting conduit 84. The first fitting member 80 may be fixedly and sealingly mounted to the non-orbiting scroll 54. The second fitting member 82 may be fixedly and sealingly mounted to the shell assembly 12 (e.g., to the shell 21). The connecting conduit 84 may sealingly engage the first and second fitting members 80, 82.

Figure 4:
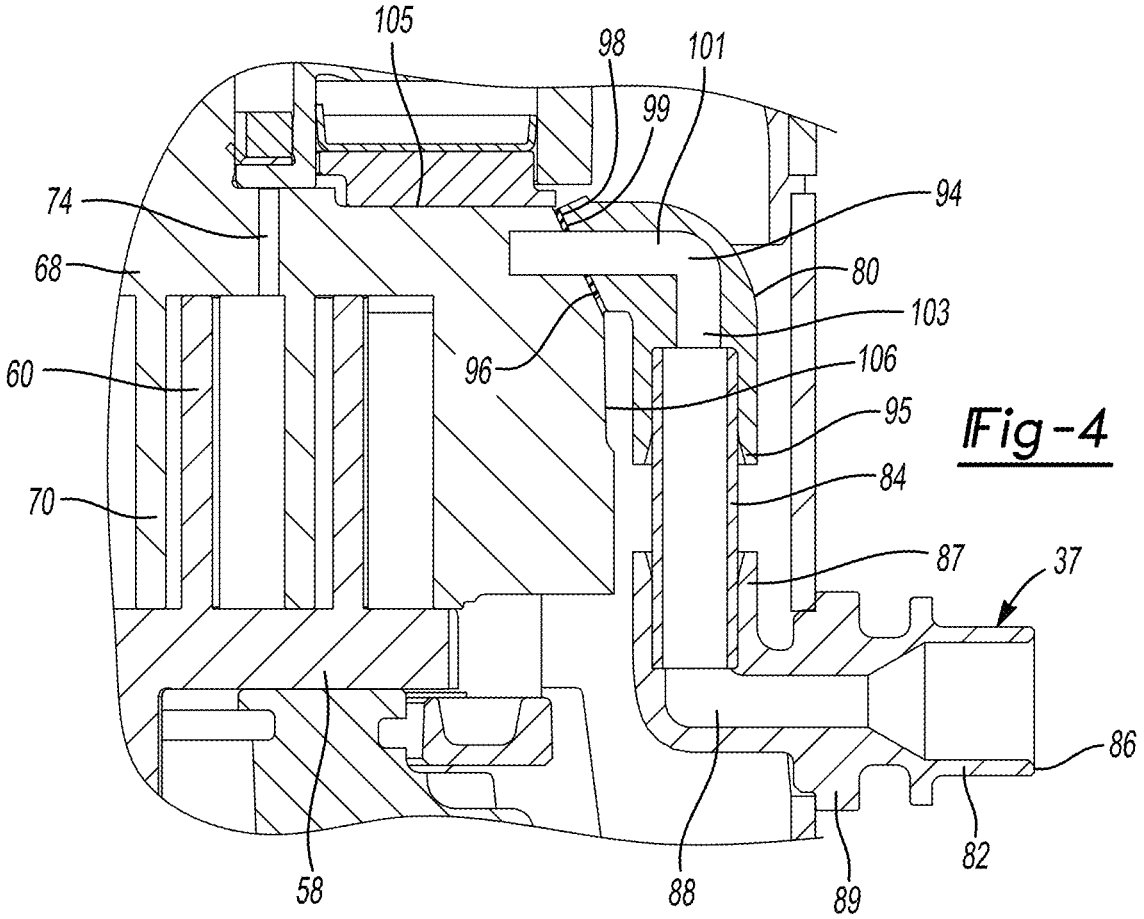
FIG. 4 is a partial cross-sectional view of the compressor.

As shown in FIG. 4, the second fitting member 82 may extend through an opening in the shell 21 such that a first end 86 of the second fitting member 82 is disposed outside of the shell assembly 12 and a second end 87 of the second fitting member 82 is disposed within the shell assembly 12 (e.g., in the suction chamber 35). The second fitting member 82 includes a passage 88 that extends through the first and second ends 86, 87 of the second fitting member 82. The passage 88 may be generally L-shaped. The first end 86 of the second fitting member 82 may be sealingly engaged with the fluid-injection conduit 23 (FIG. 1). An end of the connecting conduit 84 may be received into the passage 88 at the second end 87. A seal (e.g., an O-ring) may be disposed within the passage 88 and sealingly engage the connecting conduit 84 and the second fitting member 82. The second fitting member 82 may include a flange 89 that engages the shell 21. The flange 89 may be welded to the shell 21, for example.

Figure 5:
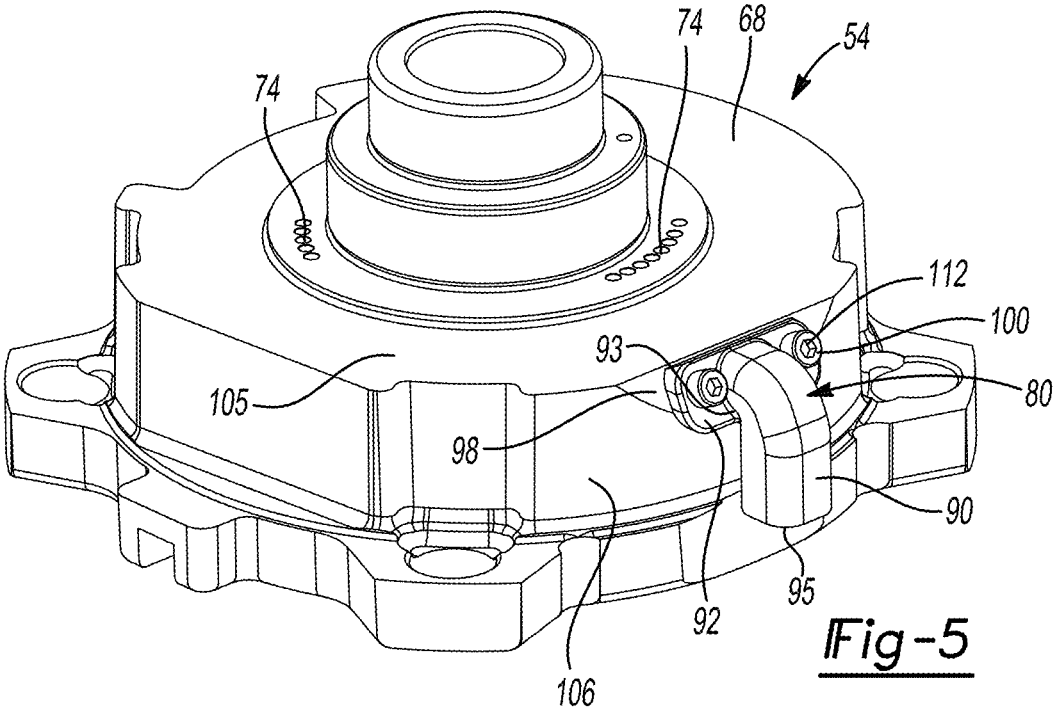
FIG. 5 is a perspective view of a non-orbiting scroll and a fitting member of the compressor.
Figure 6:
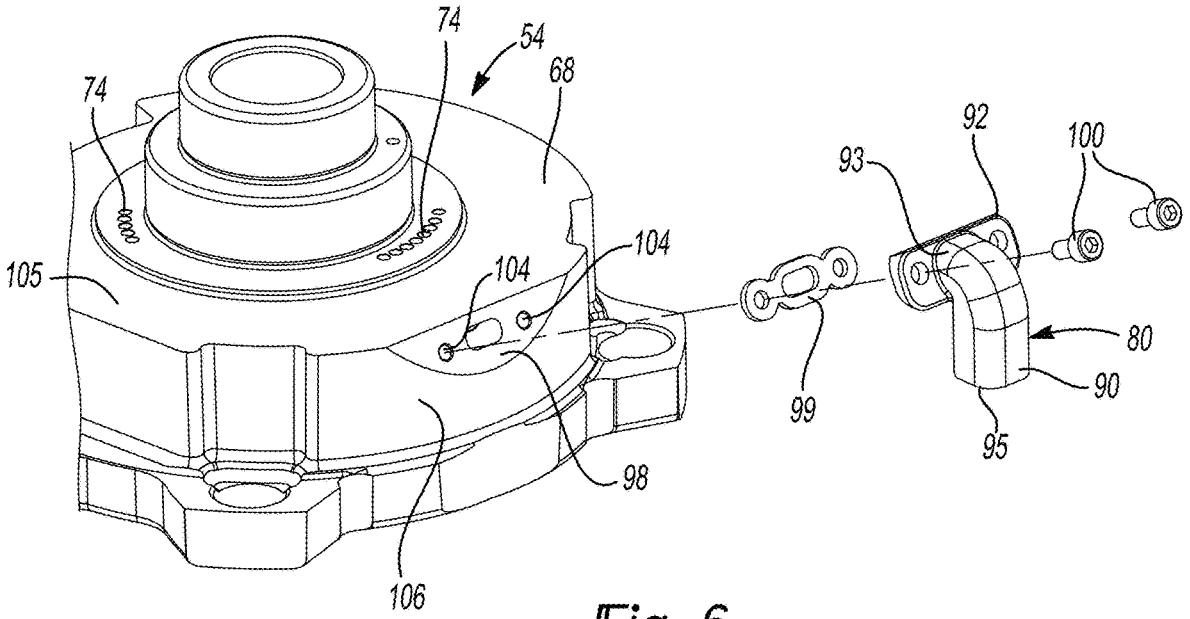
FIG. 6 is an exploded view of the non-orbiting scroll and fitting member.
Figure 7:
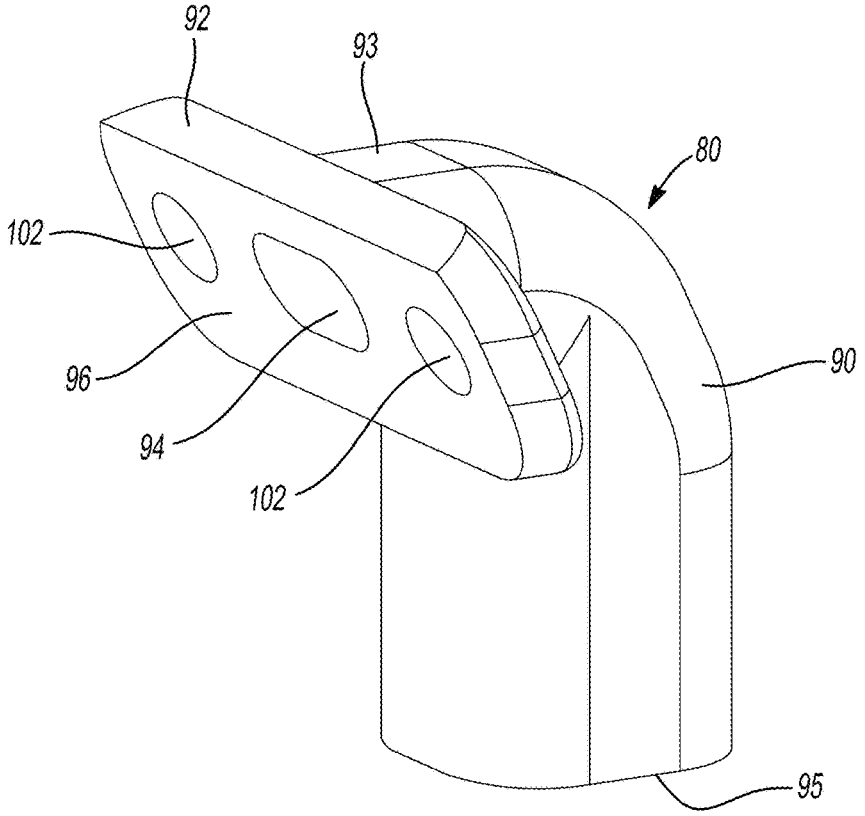
FIG. 7 is a perspective view of the fitting member.
Figure 8:
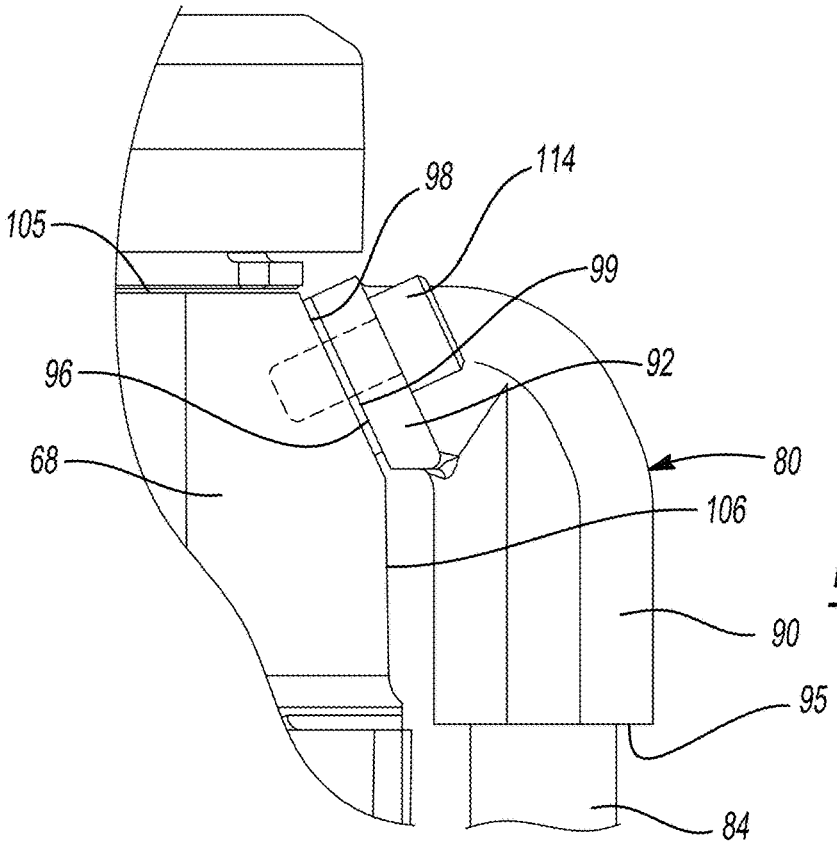
FIG. 8 is a partial side view of the non-orbiting scroll and fitting member.

As shown in FIGS. 5-7, the first fitting member 80 may include a body 90 and a flange 92 extending from a first end 93 of the body 90. The first fitting member 80 may include a passage 94 that extends through the body 90 and the flange 92. The passage 94 may be generally L-shaped and may include a first portion 101 and a second portion 103 (FIG. 4) that are perpendicular to each other. An end of the connecting conduit 84 may be received into the passage 94 (e.g., in the second portion 103) at the second end 95 of the body 90. A seal (e.g., an O-ring) may be disposed within the passage 94 and sealingly engage the connecting conduit 84 and the body 90.

The flange 92 of the first fitting member 80 may include a first mounting surface 96 that engages a second mounting surface 98 of the non-orbiting scroll 54. A gasket 99 may be disposed between and sealingly contact the first and second mounting surfaces 96, 98. One or more fasteners 100 (e.g., threaded bolts) may extend through apertures 102 (FIG. 7) in the flange 92 and threadably engage apertures 104 (FIG. 6) in the mounting surface 98 of the non-orbiting scroll 54.

The first and second mounting surfaces 96, 98 may be disposed at a non-perpendicular angle relative to a longitudinal axis (or axis of rotational symmetry) A1 of the shell 21 (FIG. 2). Stated another way, the first and second mounting surfaces 96, 98 are disposed at a non-perpendicular angle relative to the directions in which the first and second portions 101, 103 of passage 94 extend. Stated yet another way, the first and second mounting surfaces 96, 98 define planes that are disposed at a non-perpendicular angle relative to surfaces 105, 106 (FIGS. 4-6) of the non-orbiting scroll 54. The surfaces 105, 106 are adjacent to the second mounting surface 98.

The apertures 102, 104 may extend perpendicular to the first and second mounting surfaces 96, 98. Therefore, the shafts of the fasteners 100 extend perpendicular to the first and second mounting surfaces 96, 98, which allows the fasteners 100 to clamp the first fitting member 80 to the second mounting surface 98 in a manner that provides good sealing contact between the mounting surfaces 96, 98 and the gasket 99.

During assembly of the compressor 10, the non-orbiting scroll 54 may be installed into an open end of the shell 21 (i.e., the top end of the shell 21 that is open before the end cap 24 and partition 26 are installed onto the shell 21) with the first fitting member 80 loosely secured to the non-orbiting scroll 54 (i.e., with the fasteners 100 not torqued tightly to allow some amount of movement of the first fitting member 80 relative to the scroll 54). This allows the position of the first fitting member 80 relative to the non-orbiting scroll 54 to be adjusted after installing the scroll 54 into the shell 21 so that the first fitting member 80 can be properly aligned relative to the connecting conduit 84 and the second fitting member 82. Once the position of the first fitting member 80 has been properly aligned with the connecting conduit 84 and the second fitting member 82, the fasteners 100 can be torqued tightly to fixedly secure the first fitting member 80 to the non-orbiting scroll 54.

Figure 9:
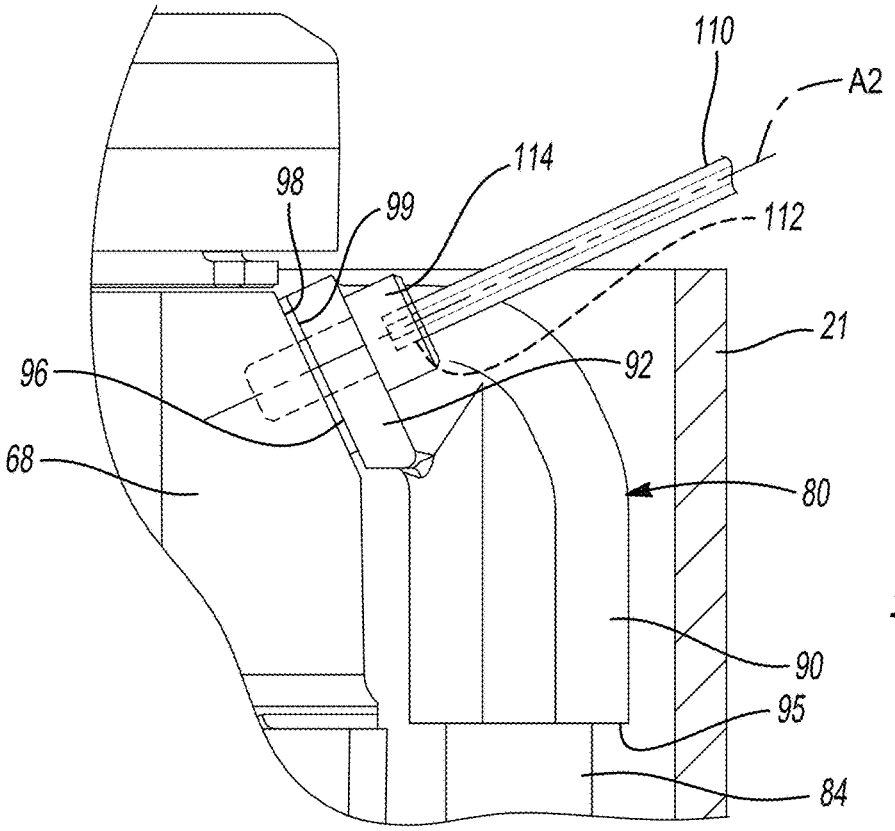
FIG. 9 is a partial side view of the non-orbiting scroll, fitting member, and a shell of the compressor.

As shown in FIG. 9, the top end of the shell 21 may be aligned with or extend vertically higher than the fasteners 100. A longitudinal axis A2 of a shaft of each fastener 100 extends out of the shell 21 without intersecting the shell 21. As shown in FIG. 9, the above-described angled orientation of the mounting surfaces 96, 98 and fasteners 100 provides clearance for a wrench (or screwdriver or other tool) 110 to engage the heads 114 of fasteners 100 (e.g., such that the wrench (or screwdriver) 110 can be received in a socket (or one or more slots) 112 in the head 114 of the fasteners 100) without interference from the shell 21. That is, the angled orientation of the mounting surfaces 96, 98 and fasteners 100 allows the wrench 110 to be angled downward into the open end of the shell 21 to easily and securely engage the fasteners 100 so that the fasteners 100 can be torqued as desired to securely fix the first fitting member 80 to the non-orbiting scroll 54. Thereafter, the partition 26 and end cap 24 can be installed onto the end of the shell 21.

As shown in FIG. 3, the passage 94 in the first fitting member 80 may be in communication with one or more passages 120 formed in the end plate 68 of the non-orbiting scroll 54. The passages 120 may be in fluid communication with one or more of the capacity-modulation passages 74 in the non-orbiting scroll 54. In this manner, when the control valve 25 is open, working fluid from the fluid-injection conduit 23 may flow through the passage 88 of the second fitting member 82, through the connecting conduit 84, through the passage 94 of the first fitting member 80, through the passages 120, through the capacity modulation passages 74, and into intermediate-pressure fluid pockets (fluid pockets at radially intermediate positions) to increase the capacity of the compressor 10.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A compressor comprising:

a shell and an end cap extending from an end of the shell;

a first scroll disposed within the shell and having a first end plate and a first spiral wrap extending from the first end plate;

a second scroll disposed at least partially within the shell and having a second end plate and a second spiral wrap extending from the second end plate, wherein the first and second spiral wraps cooperate to define fluid pockets therebetween, wherein the fluid pockets are movable from a radially outer position, a radially intermediate position, and a radially inner position, and wherein the second end plate includes a capacity-modulation passage in fluid communication with one of the fluid pockets at the radially intermediate position; and a first fitting member having a first mounting surface mounted to a second mounting surface of the second scroll, wherein the first and second mounting surfaces are disposed at an angle relative to a longitudinal axis of the shell, wherein the first and second mounting surfaces are disposed at a non-perpendicular angle and non-parallel angle relative to the longitudinal axis of the shell.

2. The compressor of claim 1, further comprising a fastener extending through an aperture in the first fitting member and into an aperture in the second mounting surface, wherein a longitudinal axis of a shaft of the fastener extends in a direction perpendicular to the first and second mounting surfaces.

3. The compressor of claim 2, wherein the longitudinal axis of a shaft of the fastener extends out of the shell without intersecting the shell.

4. The compressor of claim 3, wherein the first fitting member includes a body and a flange extending from an end of the body, wherein the first fitting member includes a passage that extends through the body and the flange, wherein the passage in the first fitting member is in fluid communication with the capacity-modulation passage, and wherein the flange defines the first mounting surface.

5. The compressor of claim 4, wherein the passage of the first fitting member includes a first portion and a second portion that is perpendicular to the first portion, and wherein the first and second mounting surfaces are disposed at non-perpendicular angles relative to the first and second portions.

6. The compressor of claim 5, further comprising a gasket disposed between and sealingly engaging the first and second mounting surfaces.

7. The compressor of claim 6, further comprising a second fitting member in fluid communication with the first fitting member, wherein the second fitting member extends through an opening in the shell.

8. The compressor of claim 7, further comprising a connecting conduit in fluid communication with the first and second fitting members, wherein the connecting conduit is received within the passage in the first fitting member and is received within a passage in the second fitting member.

9. The compressor of claim 8, wherein the first scroll member is an orbiting scroll, and wherein the second scroll member is a non-orbiting scroll.

10. The compressor of claim 9, further comprising a modulation valve ring engaging the second scroll and configured to selectively block the capacity-modulation passage.

11. A compressor comprising:

a shell and an end cap extending from an end of the shell;

a first scroll disposed within the shell and having a first end plate and a first spiral wrap extending from the first end plate;

a second scroll disposed at least partially within the shell and having a second end plate and a second spiral wrap extending from the second end plate, wherein the first and second spiral wraps cooperate to define fluid pockets therebetween, wherein the fluid pockets are movable from a radially outer position, a radially intermediate position, and a radially inner position, and wherein the second end plate includes a capacity-modulation passage in fluid communication with one of the fluid pockets at the radially intermediate position; and a first fitting member having a first mounting surface mounted to a second mounting surface of the second scroll, wherein the first and second mounting surfaces are disposed at a non-perpendicular angle and a non-parallel angle relative to a longitudinal axis of the shell, and wherein the first fitting member includes a passage in fluid communication with the capacity-modulation passage.

12. The compressor of claim 11, further comprising a fastener extending through an aperture in the first fitting member and into an aperture in the second mounting surface, wherein a longitudinal axis of a shaft of the fastener extends in a direction perpendicular to the first and second mounting surfaces.

13. The compressor of claim 12, wherein the longitudinal axis of a shaft of the fastener extends out of the shell without intersecting the shell.

14. The compressor of claim 13, wherein the first fitting member includes a body and a flange extending from an end of the body, wherein the first fitting member includes a passage that extends through the body and the flange, and wherein the flange defines the first mounting surface.

15. The compressor of claim 14, wherein the passage of the first fitting member includes a first portion and a second portion that is perpendicular to the first portion, and wherein the first and second mounting surfaces are disposed at non-perpendicular angles relative to the first and second portions.

16. The compressor of claim 15, further comprising a second fitting member in fluid communication with the first fitting member, wherein the second fitting member extends through an opening in the shell.

17. The compressor of claim 16, further comprising a connecting conduit in fluid communication with the first and second fitting members, wherein the connecting conduit is received within the passage in the first fitting member and is received within a passage in the second fitting member.

18. The compressor of claim 17, further comprising a gasket disposed between and sealingly engaging the first and second mounting surfaces.

19. The compressor of claim 18, wherein the first scroll member is an orbiting scroll, and wherein the second scroll member is a non-orbiting scroll.

* * * * *